US011130921B2

(12) United States Patent
Oprins et al.

(10) Patent No.: US 11,130,921 B2
(45) Date of Patent: Sep. 28, 2021

(54) PROCESS FOR THE PREPARATION OF A FEEDSTOCK FOR A HYDROPROCESSING UNIT AND AN INTEGRATED HYDROTREATING AND STEAM PYROLYSIS PROCESS FOR THE DIRECT PROCESSING OF A CRUDE OIL TO PRODUCE OLEFINIC AND AROMATIC PETROCHEMICALS

(71) Applicant: SABIC GLOBAL TECHNOLOGIES B.V., Bergen op Zoom (NL)

(72) Inventors: Arno Johannes Maria Oprins, Geleen (NL); Andrew Mark Ward, Geleen (NL); Egidius Jacoba Maria Schaerlaeckens, Geleen (NL); Joris Van Willigenburg, Geleen (NL)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 7 days.

(21) Appl. No.: 16/481,756

(22) PCT Filed: Feb. 2, 2018

(86) PCT No.: PCT/IB2018/050683
§ 371 (c)(1),
(2) Date: Jul. 29, 2019

(87) PCT Pub. No.: WO2018/142351
PCT Pub. Date: Aug. 9, 2018

(65) Prior Publication Data

US 2019/0390124 A1 Dec. 26, 2019

(30) Foreign Application Priority Data

Feb. 2, 2017 (EP) ..... 17154391
Feb. 2, 2017 (EP) ..... 17154394
(Continued)

(51) Int. Cl.
*C10G 69/06* (2006.01)
*C10G 67/04* (2006.01)

(52) U.S. Cl.
CPC ..... *C10G 69/06* (2013.01); *C10G 2300/206* (2013.01); *C10G 2300/308* (2013.01);
(Continued)

(58) Field of Classification Search
None
See application file for complete search history.

(56) References Cited

U.S. PATENT DOCUMENTS 6,153,087 A 11/2000 Bigeard et al.
6,270,654 B1 8/2001 Colyar et al.
(Continued)

FOREIGN PATENT DOCUMENTS

CN 104093818 10/2014
CN 104105783 10/2014
(Continued)

OTHER PUBLICATIONS

International Search Report and Written Opinion issued in Corresponding International Patent Application No. PCT/IB2018/050683, dated Apr. 24, 2018.
(Continued)

*Primary Examiner* — Philip Y Louie
(74) *Attorney, Agent, or Firm* — Norton Rose Fulbright US LLP

(57) ABSTRACT

Integrated hydrotreating and steam pyrolysis processes for the direct processing of a crude oil to produce olefinic and aromatic petrochemicals.

18 Claims, 4 Drawing Sheets

(30) Foreign Application Priority Data

Feb. 2, 2017 (EP) ..... 17154395
Feb. 2, 2017 (EP) ..... 17154396

(52) U.S. Cl.
CPC ..... *C10G 2400/20* (2013.01); *C10G 2400/22* (2013.01); *C10G 2400/30* (2013.01)

(56) References Cited

U.S. PATENT DOCUMENTS

| | | | | |
|---|---|---|---|---|
| 7,214,308 | B2 | 5/2007 | Colyar | |
| 7,704,377 | B2 | 4/2010 | Duddy et al. | |
| 7,938,952 | B2 | 5/2011 | Colyar et al. | |
| 8,926,824 | B2 | 1/2015 | Morel | |
| 9,005,430 | B2 | 4/2015 | Fournier et al. | |
| 9,284,502 | B2 | 3/2016 | Bourane et al. | |
| 9,840,674 | B2 | 12/2017 | Weiss et al. | |
| 2005/0211603 | A1 | 9/2005 | Guillaume et al. | |
| 2007/0295640 | A1 | 12/2007 | Taq et al. | |
| 2008/0093262 | A1 | 4/2008 | Gragnani et al. | |
| 2011/0083996 | A1 | 4/2011 | Shafi et al. | |
| 2013/0197283 | A1 | 8/2013 | Shafi et al. | |
| 2013/0197284 | A1 | 8/2013 | Bourane et al. | |
| 2013/0197289 | A1* | 8/2013 | Bourane | C10G 67/04 585/469 |
| 2013/0220884 | A1† | 8/2013 | Bourane | |
| 2013/0228495 | A1* | 9/2013 | Shafi | C10G 19/00 208/61 |
| 2013/0233766 | A1* | 9/2013 | Shafi | C10G 45/00 208/61 |
| 2013/0233768 | A1* | 9/2013 | Bourane | C10G 55/04 208/61 |
| 2014/0299515 | A1 | 10/2014 | Weiss et al. | |
| 2016/0122666 | A1 | 5/2016 | Weiss et al. | |
| 2017/0015916 | A1 | 1/2017 | Oprins et al. | |

FOREIGN PATENT DOCUMENTS

| | | |
|---|---|---|
| WO | WO 2016/146326 | 9/1916 |
| WO | WO 2009/073436 | 6/2009 |
| WO | WO 2010/009077 | 1/2010 |
| WO | WO 2010/009082 | 1/2010 |
| WO | WO 2010/009089 | 1/2010 |
| WO | WO 2013/033293 | 3/2013 |
| WO | WO 2013/112967 | 8/2013 |

OTHER PUBLICATIONS

Office Action issued in Corresponding Indian Application No. 201917030286, dated Jan. 18, 2021.
Office Action issued in Corresponding Chinese Application No. 201880020917.4, dated Mar. 19, 2021 (No English Translation provided).

* cited by examiner
† cited by third party

PROCESS FOR THE PREPARATION OF A FEEDSTOCK FOR A HYDROPROCESSING UNIT AND AN INTEGRATED HYDROTREATING AND STEAM PYROLYSIS PROCESS FOR THE DIRECT PROCESSING OF A CRUDE OIL TO PRODUCE OLEFINIC AND AROMATIC PETROCHEMICALS

CROSS REFERENCE TO RELATED APPLICATIONS

This application is a national phase application under 35 U.S.C. § 371 of International Application No. PCT/IB2018/050683, filed Feb. 2, 2018 which claims the benefit of priority of European Patent Application No. 17154394.5, filed Feb. 2, 2017, European Patent Application No. 17154395.2, filed Feb. 2, 2017, European Patent Application No. 17154391.1, filed Feb. 2, 2017, and European Patent Application No. 17154396.0, filed Feb. 2, 2017, the entire contents of each of which are hereby incorporated by reference in their entireties.

FIELD OF THE INVENTION

The present invention relates to a process for the preparation of a feedstock for a hydroprocessing unit, wherein said feedstock is based on crude oil containing asphaltenes.

The present invention also relates to an integrated hydrotreating and steam pyrolysis process for the direct processing of a crude oil to produce olefinic and aromatic petrochemicals.

BACKGROUND OF THE INVENTION

Refineries are facing the challenges of oil becoming heavier and worse. Asphaltenes are the most difficult components in processing of heavy oils, which is a complex macromolecule that contains the majority of impurities such as S, N, Ni and V. The composition, structure and concentration of asphaltenes highly determine the quality and processing effect of heavy oil to a certain degree. Hydroprocessing is one of the most effective technologies of heavy oil processing. However, during hydroprocessing carbon deposit and pore blocking on the surface of catalysts are easily to occur because of the congregation and coking of the constituents of asphaltenes, which can greatly shorten the operational life span of the catalyst and the running period of the plant. These high molecular weight, large multi-ring aromatic hydrocarbon molecules or associated heteroatom-containing (e.g., S, N, O) multi-ring hydrocarbon molecules in heavy oils are called asphaltenes. A significant portion of the sulphur is contained within the structure of these asphaltenes. Due to the large aromatic structures of the asphaltenes, the sulphur can be refractory in nature and can be difficult to remove.

Asphaltenes are thus present in the crude oil along with other components which aid in keeping them in dissolved state. In the process of crude distillation, most of these other components present in the lower boiling ranges than asphaltenes are removed from the crude oil. This concentrates the asphaltenes in the residue. Depending on the solubility of asphaltenes in the crude oil residue, it can crash out of the solution due to aggregation and precipitate as solids. Precipitated asphaltenes in downstream hydroprocessing units leads to catalyst fouling and lower time-on-stream for the hydroprocessing reactors.

US2007295640 relates to a composition comprising an asphaltenes solvent and a viscosity reducing agent, the asphaltenes solvent and viscosity reducing agent present in a ratio so as to substantially reduce viscosity of an asphaltenes-containing material while substantially negating deposition of asphaltenes either in a reservoir, in production tubing, or both when mixed or otherwise.

WO2013033293 relates to a process for producing a hydro processed product, comprising: exposing a combined feedstock comprising a heavy oil feed component and a solvent component to a hydroprocessing catalyst to form a hydro processed effluent, separating the hydroprocessing effluent to form at least a liquid effluent and fractionating a first portion of the liquid effluent to form at least a distillate product, wherein the solvent comprises at least a portion of the distillate product, at least 90 wt. % of the at least a portion of the distillate product having a boiling point in a boiling range of 149° C. to 399° C.

WO2013112967 relates to an integrated solvent deasphalting, hydrotreating and steam pyrolysis process for direct processing of a crude oil to produce petrochemicals such as olefins and aromatics.

US2013220884 and US2013197284 relate to an integrated hydrotreating, solvent deasphalting and steam pyrolysis process for direct processing of a crude oil to produce petrochemicals such as olefins and aromatics.

US2013197283 relates to an integrated hydrotreating and steam pyrolysis process for direct processing of a crude oil to produce petrochemicals such as olefins and aromatics.

Cracked distillate is a by-product obtained in the thermal cracking of a cracker feedstock, which by-product comprises a mixture of hydrocarbons with a boiling range of between 80 and 260° C., at least 35 wt. % of which consists of unsaturated hydrocarbons. 'Cracked distillate' is also understood to be a fraction of unsaturated compounds that can be polymerised into a resin, obtained from distillation of coal tar. The liquid product of the cracking process is known as carbon black oil. Carbon black oil is highly aromatic and constitutes a valuable feedstock for the production of carbon black and for the manufacture of electrodes.

In a situation in which the commercial need for both cracked distillate and carbon black oil is decreasing new technical markets and end uses for these products need to be developed.

Not only carbon deposit and pore blocking on the surface of catalysts are unwanted phenomena but the presence of high amounts of sulphur in the feedstock as well. These sulphur-containing and/or nitrogen-containing organic compounds may compete for the active catalyst sites in the reaction zone in hydroprocessing units as a result of which hydrocracking reaction performance is affected.

OBJECTS OF THE INVENTION

An object of the present invention is to provide a process for the preparation of a feedstock for a hydroprocessing unit in which feedstock the aggregation of asphaltenes in crude oil is reduced to a minimum, i.e. as to keep the asphaltenes in a dissolved state.

Another object of the present invention is to provide a feedstock for a hydroprocessing unit resulting in a long operational life span of the catalyst and a long running period of the plant.

Another object of the present invention is to provide a valuable use for steam cracker cracked distillate (CD) and steam cracker carbon black oil (CBO).

Another object of the present invention is to provide an integrated hydrotreating and steam pyrolysis process for the direct processing of a crude oil to produce olefinic and aromatic petrochemicals wherein crude oil fractions that do not benefit much from a solvent deasphalting are not subjected to such a solvent deasphalting process, namely naphtha, kerosene and diesel fractions.

Another object of the present invention is to provide an integrated hydrotreating and steam pyrolysis process for the direct processing of a crude oil to produce olefinic and aromatic petrochemicals wherein non-upgradable crude oil fractions are not subjected to such a hydrotreating process.

SUMMARY OF THE INVENTION

The present invention thus relates in part to an integrated hydrotreating and steam pyrolysis process for the direct processing of a crude oil to produce olefinic and aromatic petrochemicals, the process comprising the steps of (a1) separating the crude oil into light components and heavy components; (b1) charging the heavy components to a solvent deasphalting zone with an effective amount of solvent for producing a deasphalted and demetallized oil stream and a bottom asphalt phase; (c1) charging the deasphalted and demetallized oil stream and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (d1) thermally cracking the hydroprocessed effluent and the light components in the presence of steam to produce a mixed product stream; (e1) separating the thermally cracked mixed product stream; (f1) purifying hydrogen recovered in step (e1) and recycling it to step (c1); (g1) recovering olefins and aromatics from the separated mixed product stream; and (h1) recovering a combined stream of pyrolysis fuel oil from the separated mixed product stream and heavy components from step (b1) as a fuel oil blend.

The present invention also relates to an integrated hydrotreating and steam pyrolysis process for the direct processing of a crude oil to produce olefinic and aromatic petrochemicals, the process comprising the steps of (a2) separating the crude oil into light components and heavy components; (b2) charging the heavy components to a first solvent deasphalting zone with an effective amount of solvent for producing a first deasphalted and demetallized oil stream and a bottom asphalt phase; (c2) charging the deasphalted and demetallized oil stream and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (d2) charging the hydroprocessed effluent to a second solvent deasphalting zone with an effective amount of solvent to produce a second deasphalted and demetallized oil stream and a bottom asphalt phase; (e2) thermally cracking the second deasphalted and demetallized oil stream in the presence of steam to produce a mixed product stream; (f2) separating the thermally cracked mixed product stream; (g2) purifying hydrogen recovered in step (f2) and recycling it to step (c2); (h2) recovering olefins and aromatics from the separated mixed product stream; and (i2) recovering a combined stream of pyrolysis fuel oil from the separated mixed product stream and heavy components from step (b2) as a fuel oil blend.

The present invention additionally relates to an integrated solvent deasphalting, hydrotreating and steam pyrolysis process for the direct processing of a crude oil to produce olefinic and aromatic petrochemicals, the process comprising the steps of (a3) charging the crude oil to a solvent deasphalting zone with an effective amount of solvent for producing a deasphalted and demetallized oil stream and a bottom asphalt phase; (b3) charging the deasphalted and demetallized oil stream and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (c3) charging the hydroprocessed effluent to a second solvent deasphalting zone with an effective amount of solvent to produce a second deasphalted and demetallized oil stream and a bottom asphalt phase; (d3) thermally cracking the second deasphalted and demetallized oil stream and hydroprocessed effluent in the presence of steam to produce a mixed product stream; (e3) separating the thermally cracked mixed product stream; (f3) purifying hydrogen recovered in step (d3) and recycling it to step (b3); (g3) recovering olefins and aromatics from the separated mixed product stream; and (h3) recovering pyrolysis fuel oil from the separated mixed product stream.

The present invention also relates to an integrated hydrotreating and steam pyrolysis process for the direct processing of a crude oil to produce olefinic and aromatic petrochemicals, the process comprising the steps of (a4) separating the crude oil into light components and heavy components; (b4) charging the light components and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (c4) charging the hydroprocessed effluent to a solvent deasphalting zone with an effective amount of solvent to produce a deasphalted and demetallized oil stream and a bottom asphalt phase; (d4) thermally cracking the deasphalted and demetallized oil stream in the presence of steam to produce a mixed product stream; (e4) separating the thermally cracked mixed product stream; (f4) purifying hydrogen recovered in step (e4) and recycling it to step (b4); (g4) recovering olefins and aromatics from the separated mixed product stream; and (h4) recovering a combined stream of pyrolysis fuel oil from the separated mixed product stream and heavy components from step (a4) as a fuel oil blend.

The following includes definitions of various terms and phrases that may be used throughout this specification.

The terms "about" or "approximately" are defined as being close to as understood by one of ordinary skill in the art. In one non-limiting embodiment the terms are defined to be within 10%, preferably, within 5%, more preferably, within 1%, and most preferably, within 0.5%.

The terms "wt. %", "vol. %" or "mol. %" refers to a weight, volume, or molar percentage of a component, respectively, based on the total weight, the total volume, or the total moles of material that includes the component. In a non-limiting example, 10 moles of component in 100 moles of the material is 10 mol. % of component.

The term "substantially" and its variations are defined to include ranges within 10%, within 5%, within 1%, or within 0.5%.

The terms "inhibiting" or "reducing" or "preventing" or "avoiding" or any variation of these terms, when used in the claims and/or the specification, includes any measurable decrease or complete inhibition to achieve a desired result.

The term "effective," as that term is used in the specification and/or claims, means adequate to accomplish a desired, expected, or intended result.

The use of the words "a" or "an" when used in conjunction with the term "comprising," "including," "containing," or "having" in the claims or the specification may mean "one," but it is also consistent with the meaning of "one or more," "at least one," and "one or more than one."

The words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The process of the present invention can "comprise," "consist essentially of," or "consist of" particular ingredients, components, compositions, etc., disclosed throughout the specification.

In the context of the present invention, thirty-one embodiments are now described. Embodiment 1 is an integrated hydrotreating and steam pyrolysis process for the direct processing of a crude oil to produce olefinic and aromatic petrochemicals. The process includes the steps of (a1) separating the crude oil into light components and heavy components; (b1) charging the heavy components to a solvent deasphalting zone with an effective amount of solvent for producing a deasphalted and demetallized oil stream and a bottom asphalt phase; (c1) charging the deasphalted and demetallized oil stream and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (d1) thermally cracking the hydroprocessed effluent and the light components in the presence of steam to produce a mixed product stream; (e1) separating the thermally cracked mixed product stream; (f1) purifying hydrogen recovered in step (e1) and recycling it to step (e1); (g1) recovering olefins and aromatics from the separated mixed product stream; and (h1) recovering a combined stream of pyrolysis fuel oil from the separated mixed product stream and heavy components from step (b1) as a fuel oil blend. Embodiment 2 is the integrated process of embodiment 1, further including the steps of separating the hydroprocessing zone reactor effluents in a high pressure separator to recover a gas portion that is cleaned and recycled to the hydroprocessing zone as an additional source of hydrogen, and a liquid portion, and separating the liquid portion from the high pressure separator in a low pressure separator into a gas portion and a liquid portion, wherein the liquid portion from the low pressure separator is the hydroprocessed effluent subjected to thermal cracking and the gas portion from the low pressure separator is combined with the mixed product stream after the steam pyrolysis zone and before separation in step (d1). Embodiment 3 is the integrated process of embodiment 1 wherein the thermal cracking step includes the steps of heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. Embodiment 4 is the integrated process of embodiment 3, wherein the discharged liquid fraction is blended with pyrolysis fuel oil recovered in step (g1). Embodiment 5 is the integrated process of embodiment 3, wherein separating the heated hydroprocessed effluent into a vapor fraction and a liquid fraction is with a vapor-liquid separation device based on physical and mechanical separation. Embodiment 6 is the integrated process of embodiment 5, wherein the vapor-liquid separation device includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Embodiment 7 is the integrated process of embodiment 1, wherein step (d1) includes the steps of compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e1) and pyrolysis fuel oil as in step (f1) from the remainder of the dehydrated compressed thermally cracked mixed product stream with a reduced content of hydrogen sulfide and carbon dioxide; and step (e1) comprises purifying recovered hydrogen from the dehydrated compressed thermally cracked mixed product stream with a reduced content of hydrogen sulfide and carbon dioxide for recycle to the hydroprocessing zone. Embodiment 8 is the integrated process of embodiment 7, wherein recovering hydrogen from the dehydrated compressed thermally cracked mixed product stream with a reduced content of hydrogen sulfide and carbon dioxide further includes the step of separately recovering methane for use as fuel for burners and/or heaters in the thermal cracking step.

Embodiment 9 is an integrated hydrotreating and steam pyrolysis process for the direct processing of a crude oil to produce olefinic and aromatic petrochemicals. The process includes the steps of (a2) separating the crude oil into light components and heavy components; (b2) charging the heavy components to a first solvent deasphalting zone with an effective amount of solvent for producing a first deasphalted and demetallized oil stream and a bottom asphalt phase; (c2) charging the deasphalted and demetallized oil stream and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (d2) charging the hydroprocessed effluent to a second solvent deasphalting zone with an effective amount of solvent to produce a second deasphalted and demetallized oil stream and a bottom asphalt phase; (e2) thermally cracking the second deasphalted and demetallized oil stream in the presence of steam to produce a mixed product stream; (f2) separating the thermally cracked mixed product stream; (g2) purifying hydrogen recovered in step (f2) and recycling it to step (c2); (h2) recovering olefins and aromatics from the separated mixed product stream; and (i2) recovering a combined stream of pyrolysis fuel oil from the separated mixed product stream and heavy components from step (b2) as a fuel oil blend. Embodiment 10 is the integrated process of embodiment 9, further including separating the second deasphalted and demetallized oil stream in a separation zone to recover a vapor portion that is sent to a steam pyrolysis zone, and a liquid portion, wherein the liquid portion is discharged and blended with pyrolysis fuel oil from the product separation zone as recited in step (f2). Embodiment 11 is the integrated process of embodiment 9, wherein the thermal cracking step includes heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. Embodiment 12 is the integrated process of embodiment 11, wherein the discharged liquid fraction is blended with pyrolysis fuel oil recovered in step (g2). Embodiment 13 is the integrated process of embodiment 11, wherein separating the heated hydroprocessed effluent into a vapor fraction and a liquid fraction is with a vapor-liquid separation device based on physical and mechanical separation. Embodiment 14 is the integrated process of embodiment 13, wherein the vapor-liquid separation device includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Embodiment 15 is the integrated process of embodiment 9, wherein step (d2) includes compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e2) and pyrolysis fuel oil as in step (f2) from the remainder of the dehydrated compressed thermally cracked mixed product stream with a reduced content of hydrogen sulfide and carbon dioxide; and step (e2) includes purifying recovered hydrogen from the dehydrated compressed thermally cracked mixed product stream with a reduced content of hydrogen sulfide and carbon dioxide for recycle to the hydroprocessing zone. Embodiment 16 is the integrated process of embodiment 15, wherein recovering hydrogen from the dehydrated compressed thermally cracked mixed product stream with a reduced content of hydrogen sulfide and carbon dioxide further includes separately recovering methane for use as fuel for burners and/or heaters in the thermal cracking step.

Embodiment 17 is an integrated solvent deasphalting, hydrotreating and steam pyrolysis process for the direct processing of a crude oil to produce olefinic and aromatic petrochemicals. This process includes the steps of (a3) charging the crude oil to a solvent deasphalting zone with an effective amount of solvent for producing a deasphalted and demetallized oil stream and a bottom asphalt phase; (b3) charging the deasphalted and demetallized oil stream and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (c3) charging the hydroprocessed effluent to a second solvent deasphalting zone with an effective amount of solvent to produce a second deasphalted and demetallized oil stream and a bottom asphalt phase; (d3) thermally cracking the second deasphalted and demetallized oil stream and hydroprocessed effluent in the presence of steam to produce a mixed product stream; (e3) separating the thermally cracked mixed product stream; (f3) purifying hydrogen recovered in step (d3) and recycling it to step (b3); (g3) recovering olefins and aromatics from the separated mixed product stream; and (h3) recovering pyrolysis fuel oil from the separated mixed product stream. Embodiment 18 is the integrated process of embodiment 17, further including separating the deasphalted and demetallized oil stream in a separation zone to recover a vapor portion that is sent to a steam pyrolysis zone, and a liquid portion, wherein the liquid portion is discharged and blended with pyrolysis fuel oil from the product separation zone as recited in step (e3). Embodiment 19 is the integrated process of embodiment 17 wherein the thermal cracking step includes heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. Embodiment 20 is the integrated process of embodiment 19 wherein the discharged liquid fraction is blended with pyrolysis fuel oil recovered in step (g3). Embodiment 21 is the integrated process of embodiment 19 wherein separating the heated hydroprocessed effluent into a vapor fraction and a liquid fraction is with a vapor-liquid separation device based on physical and mechanical separation. Embodiment 22 is the integrated process of embodiment 21 wherein the vapor-liquid separation device includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Embodiment 23 is the integrated process of embodiment 17, wherein step (d3) includes compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e3) and pyrolysis fuel oil as in step (f3) from the remainder of the dehydrated compressed thermally cracked mixed product stream with a reduced content of hydrogen sulfide and carbon dioxide; and step (e3) includes purifying recovered hydrogen from the dehydrated compressed thermally cracked mixed product stream with a reduced content of hydrogen sulfide and carbon dioxide for recycle to the hydroprocessing zone. Embodiment 24 is the integrated process of embodiment 23, wherein recovering hydrogen from the dehydrated compressed thermally cracked mixed product stream with a reduced content of hydrogen sulfide and carbon dioxide further includes separately recovering methane for use as fuel for burners and/or heaters in the thermal cracking step.

Embodiment 25 is an integrated hydrotreating and steam pyrolysis process for the direct processing of a crude oil to produce olefinic and aromatic petrochemicals. The process includes the steps of (a4) separating the crude oil into light components and heavy components; (b4) charging the light components and hydrogen to a hydroprocessing zone operating under conditions effective to produce a hydroprocessed effluent reduced having a reduced content of contaminants, an increased paraffinicity, reduced Bureau of Mines Correlation Index, and an increased American Petroleum Institute gravity; (c4) charging the hydroprocessed effluent to a solvent deasphalting zone with an effective amount of solvent to produce a deasphalted and demetallized oil stream and a bottom asphalt phase; (d4) thermally cracking the deasphalted and demetallized oil stream in the presence of steam to produce a mixed product stream; (e4) separating the thermally cracked mixed product stream; (f4) purifying hydrogen recovered in step (e4) and recycling it to step (b4); (g4) recovering olefins and aromatics from the separated mixed product stream; and (h4) recovering a combined stream of pyrolysis fuel oil from the separated mixed product stream and heavy components from step (a4) as a fuel oil blend. Embodiment 26 is the integrated process of embodiment 25, further including separating the deasphalted and demetallized oil stream in a separation zone to recover a vapor portion that is sent to a steam pyrolysis zone, and a liquid portion, wherein the liquid portion is discharged and blended with pyrolysis fuel oil from the product separation zone as recited in step (e4). Embodiment 27 is the integrated process of embodiment 26 wherein the thermal cracking step includes heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. Embodiment 28 is the integrated process of embodiment 27 wherein the discharged liquid fraction is blended with pyrolysis fuel oil recovered in step (g). Embodiment 29 is the integrated process of embodiment 27 wherein separating the heated hydroprocessed effluent into a vapor fraction and a liquid fraction is with a vapor-liquid separation device based on physical and mechanical separation. Embodiment 30 is the integrated process of embodiment 29 wherein the vapor-liquid separation device includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Embodiment 30 is the integrated process of embodiment 25, wherein step (d4) includes compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e4) and pyrolysis fuel oil as in step (f4) from the remainder of the dehydrated compressed thermally cracked mixed product stream with a reduced content of hydrogen sulfide and carbon dioxide; and step (e4) includes purifying recovered hydrogen from the dehydrated compressed thermally cracked mixed product stream with a reduced content of hydrogen sulfide and carbon dioxide for recycle to the hydroprocessing zone. Embodiment 31 is the integrated process of embodiment 30, wherein recovering hydrogen from the dehydrated compressed thermally cracked mixed product stream with a reduced content of hydrogen sulfide and carbon dioxide further includes separately recovering methane for use as fuel for burners and/or heaters in the thermal cracking step.

Other objects, features and advantages of the present invention will become apparent from the following figures, detailed description, and examples. It should be understood, however, that the figures, detailed description, and examples, while indicating specific embodiments of the invention, are given by way of illustration only and are not meant to be limiting. Additionally, it is contemplated that changes and modifications within the spirit and scope of the invention will become apparent to those skilled in the art from this detailed description. In further embodiments, features from specific embodiments may be combined with features from other embodiments. For example, features from one embodiment may be combined with features from any of the other embodiments. In further embodiments, additional features may be added to the specific embodiments described herein.

DETAILED DESCRIPTION

Figure 1:
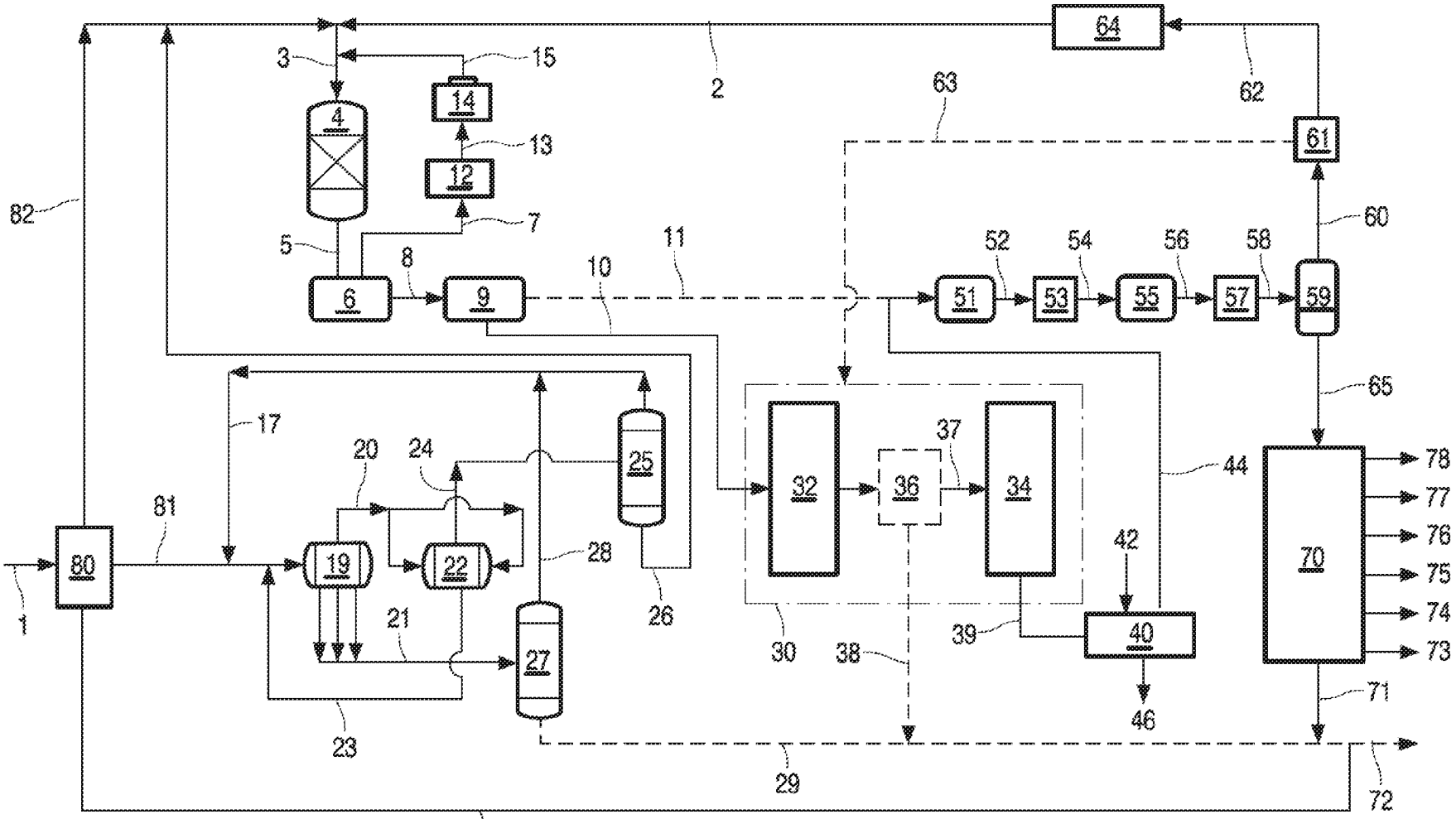
FIG. 1 is a process flow diagram of an embodiment of an embodiment of an integrated process according to the invention.

According to the present method the present inventors found that is beneficial to apply solvent deasphalting only to that part of the crude oil that benefits from it. This means that naphtha, kerosene and diesel fractions will go directly to hydroprocessing or steam cracker.

The present integrated process of embodiment 1 described above preferably further comprises a step of separating the hydroprocessing zone reactor effluents in a high pressure separator to recover a gas portion that is cleaned and recycled to the hydroprocessing zone as an additional source of hydrogen, and a liquid portion, and separating the liquid portion from the high pressure separator in a low pressure separator into a gas portion and a liquid portion, wherein the liquid portion from the low pressure separator is the hydroprocessed effluent subjected to thermal cracking and the gas portion from the low pressure separator is combined with the mixed product stream after the steam pyrolysis zone and before separation in step (d1). According to a preferred embodiment of the present method the thermal cracking step comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. It is preferred that the discharged liquid fraction is blended with pyrolysis fuel oil recovered in step (g1). The separation of the heated hydroprocessed effluent into a vapor fraction and a liquid fraction is preferably carried out with a vapor-liquid separation device based on physical and mechanical separation. Such a vapor-liquid separation device preferably includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Step (d1) of the integrated process according to the present invention preferably comprises compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e1) and pyrolysis fuel oil as in step (f1) from the remainder of the dehydrated compressed thermally cracked mixed product stream with a reduced content of hydrogen sulfide and carbon dioxide; and step (e1) preferably comprises purifying recovered hydrogen from the dehydrated compressed thermally cracked mixed product stream with a reduced content of hydrogen sulfide and carbon dioxide for recycle to the hydroprocessing zone. A preferred embodiment of this integrated process further includes a step of recovering hydrogen from the dehydrated compressed thermally cracked mixed product stream with a reduced content of hydrogen sulfide and carbon dioxide further comprises separately recovering methane for use as fuel for burners and/or heaters in the thermal cracking step.

The invention will be described in further detail below and with reference to FIG. 1, which is a process flow diagram of an embodiment of the present integrated process described herein, and includes an integrated solvent deasphalting, hydroprocessing and steam pyrolysis process and system including residual. The integrated system generally includes a feed separation zone, a solvent deasphalting zone, a selective catalytic hydroprocessing zone, a steam pyrolysis zone and a product separation zone. Feed separation zone 80 includes an inlet for receiving a feedstock stream 1, an outlet for discharging a rejected portion 83 and an outlet for discharging one or more remaining hydrocarbon portion 81, 82. Hydrocarbon portion 81 is sent to a solvent deasphalting zone. Hydrocarbon portion 82 is sent to a selective hydroprocessing zone. The cut point in separation zone 80 can be set so that it is compatible with the residue fuel oil blend, e.g., about 540° C. Separation zone 80 can be a single stage separation device such a flash separator. The cut point in separation zone 80 can be set so that there is only a separation into a rejected portion 83 and a remaining hydrocarbon portion 81, i.e. there is no remaining hydrocarbon portion 82.

The hydrocarbon fraction 82 can be mixed with an effective amount of hydrogen 2 and 15 (and if necessary a source of make-up hydrogen) and a solvent-free DA/DMO stream 26 to form a combined stream 3 and the admixture 3 is charged to the inlet of selective hydroprocessing reaction zone 4 at a temperature in the range of from 300° C. to 450° C.

In additional embodiments separation zone 80 can include, or consists essentially of (i.e., operate in the absence of a flash zone), a cyclonic phase separation device, or other separation device based on physical or mechanical separation of vapors and liquids. In embodiments in which the separation zone includes or consist essentially of a separation device based on physical or mechanical separation of vapors and liquids, the cut point can be adjusted based on vaporization temperature and the fluid velocity of the material entering the device.

Solvent deasphalting zone includes a primary settler 19, a secondary settler 22, a deasphalted/demetallized oil (DA/DMO) separation zone 25, and a separator zone 27. Primary settler 19 includes an inlet for receiving a combined stream 18 including a feed stream 1 and a solvent, which can be fresh solvent 16, recycle solvent 17, recycle solvent 28, or a combination of these solvent sources. Primary settler 19 also includes an outlet for discharging a primary DA/DMO phase 20 and several pipe outlets for discharging a primary asphalt phase 21. Secondary settler 22 includes two tee-type distributors located at both ends for receiving the primary DA/DMO phase 20, an outlet for discharging a secondary DA/DMO phase 24, and an outlet for discharging a secondary asphalt phase 23. DA/DMO separation zone 25 includes an inlet for receiving secondary DA/DMO phase 24, an outlet for discharging a solvent stream 26 and an outlet for discharging a solvent-free DA/DMO stream 26, which serves as the feed for the selective hydroprocessing zone. Separator vessel 27 includes an inlet for receiving primary asphalt phase 21, an outlet for discharging a solvent stream 28, and an outlet for discharging a bottom asphalt phase 29, which can be blended with pyrolysis fuel oil 71 from the product separation zone 70.

The rejected portion 83 from the feed separation zone and optionally the unvaporized heavy liquid fraction 38 from the vapor-liquid separation section 36 are combined with pyrolysis fuel oil 71 (e.g., materials boiling at a temperature higher than the boiling point of the lowest boiling C10 compound, known as a "C10+" stream) from separation zone 70, and this is withdrawn as a pyrolysis fuel oil blend 72, e.g., to be further processed in an off-site refinery (not shown).

The selective hydroprocessing zone includes a reactor zone 4 that includes an inlet for receiving a mixture of the solvent-free DA/DMO stream 26 and hydrogen 2 recycled from the steam pyrolysis product stream, and make-up hydrogen if necessary (not shown). Reactor zone 4 further includes an outlet for discharging a hydroprocessed effluent 5.

Reactor effluents 5 from the hydroprocessing reactor(s) are cooled in a heat exchanger (not shown) and sent to a high pressure separator 6. The separator tops 7 are cleaned in an amine unit 12 and a resulting hydrogen rich gas stream 13 is passed to a recycling compressor 14 to be used as a recycle gas 15 in the hydroprocessing reactor. A bottoms stream 8 from the high pressure separator 6, which is in a substantially liquid phase, is cooled and introduced to a low pressure cold separator 9 in which it is separated into a gas stream and a liquid stream 10. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments herein, hydrogen is recovered by combining gas stream 11, which includes hydrogen, $H_2$, $NH_3$ and any light hydrocarbons such as C1-C4 hydrocarbons, with steam cracker products 44. Liquid stream 10 serves as the feed to the steam pyrolysis zone 30.

Steam pyrolysis zone 30 generally comprises a convection section 32 and a pyrolysis section 34 that can operate based on steam pyrolysis unit operations known in the art, i.e., charging the thermal cracking feed to the convection section in the presence of steam. In addition, in certain optional embodiments as described herein (as indicated with dashed lines in FIG. 1), a vapor-liquid separation section 36 is included between sections 32 and 34. Vapor-liquid separation section 36, through which the heated steam cracking feed from convection section 32 passes, can be a separation device based on physical or mechanical separation of vapors and liquids.

A quenching zone 40 includes an inlet in fluid communication with the outlet of steam pyrolysis zone 30, an inlet for admitting a quenching solution 42, an outlet for discharging the quenched mixed product stream 44 and an outlet for discharging quenching solution 46.

In general, an intermediate quenched mixed product stream 44 is subjected to separation in a compression and fractionation section. Such compression and fractionation section are well known in the art.

In one embodiment, the mixed product stream 44 is converted into intermediate product stream 65 and hydrogen 62, which is purified in the present process and used as recycle hydrogen stream 2 in the hydroprocessing reaction zone 4. Intermediate product stream 65, which may further comprise hydrogen, is generally fractionated into end-products and residue in separation zone 70, which can include one or multiple separation units, for example as is known to one of ordinary skill in the art.

In general product separation zone 70 includes an inlet in fluid communication with the product stream 65 and plural product outlets 73-78, including an outlet 78 for discharging methane that optionally may be combined with stream 63, an outlet 77 for discharging ethylene, an outlet 76 for discharging propylene, an outlet 75 for discharging butadiene, an outlet 74 for discharging mixed butylenes, and an outlet 73 for discharging pyrolysis gasoline. Additionally an outlet is provided for discharging pyrolysis fuel oil 71. Optionally, one or both of the bottom asphalt phase 29 from separator vessel 27 and the rejected portion 38 from vapor-liquid separation section 36 are combined with pyrolysis fuel oil 71 and the mixed stream can be withdrawn as a pyrolysis fuel oil blend 72, e.g., a low sulfur fuel oil blend to be further processed in an off-site refinery. Note that while six product outlets are shown, fewer or more can be provided depending, for instance, on the arrangement of separation units employed and the yield and distribution requirements.

In a preferred embodiment of a process employing the arrangement shown in FIG. 1, a crude oil feedstock 1 is admixed with solvent from one or more sources 16, 17 and 28. The resulting mixture 18 is then transferred to the primary settler 19. By mixing and settling, two phases are formed in the primary settler 19: a primary DA/DMO phase 20 and a primary asphalt phase 21. The temperature of the primary settler 19 is sufficiently low to recover all DA/DMO from the feedstock. For instance, for a system using n-butane a suitable temperature range is about 60° C. to 150° C. and a suitable pressure range is such that it is higher than the vapor pressure of n-butane at the operating temperature e.g. about 15 to 25 bars to maintain the solvent in liquid phase. In a system using n-pentane a suitable temperature range is about 60° C. to about 180° C. and again a suitable pressure range is such that it is higher than the vapor pressure of n-pentane at the operating temperature e.g. about 10 to 25 bars to maintain the solvent in liquid phase. The temperature in the second settler is usually higher than the one in the first settler.

The primary DA/DMO phase 20 including a majority of solvent and DA/DMO with a minor amount of asphalt is discharged via the outlet located at the top of the primary settler 19 and collector pipes (not shown). The primary asphalt phase 21, which contains 40-50% by volume of solvent, is discharged via several pipe outlets located at the bottom of the primary settler 19. The primary DA/DMO phase 20 enters into the two tee-type distributors at both ends of the secondary settler 22 which serves as the final stage for the extraction. A secondary asphalt phase 23 containing a small amount of solvent and DA/DMO is discharged from the secondary settler 22 and recycled back to the primary settler 19 to recover DA/DMO. A secondary DA/DMO phase 24 is obtained and passed to the DA/DMO separation zone 25 to obtain a solvent stream 17 and a solvent-free DA/DMO stream 26. Greater than 90 wt % of the solvent charged to the settlers enters the DA/DMO separation zone 25, which is dimensioned to permit a rapid and efficient flash separation of solvent from the DA/DMO. The primary asphalt phase 21 is conveyed to the separator vessel 27 for flash separation of a solvent stream 28 and a bottom asphalt phase 29. Solvent streams 17 and 28 can be used as solvent for the primary settler 19, therefore minimizing the fresh solvent 16 requirement.

The solvents used in solvent deasphalting zone include pure liquid hydrocarbons such as propane, butanes and pentanes, as well as their mixtures. The selection of solvents depends on the requirement of DAO, as well as the quality and quantity of the final products. The operating conditions for the solvent deasphalting zone include a temperature at or below critical point of the solvent; a solvent-to-oil ratio in the range of from 2:1 to 50:1; and a pressure in a range effective to maintain the solvent/feed mixture in the settlers is in the liquid state.

The essentially solvent-free DA/DMO stream 26 is optionally steam stripped (not shown) to remove any remaining solvent, and mixed with an effective amount of hydrogen and stream 15 (and if necessary a source of make-up hydrogen) to form a combined stream 3. The admixture 3 is charged to the hydroprocessing reaction zone 4 at a temperature in the range of from 300° C. to 450° C. In certain embodiments, hydroprocessing reaction zone 4 includes one or more unit operations as described in United States Patent Publication Number 2011/0083996 and in PCT Patent Application Publication Numbers WO2010/009077, WO2010/009082, WO2010/009089 and WO2009/073436. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 4 includes more than two catalyst beds. In further embodiments hydroprocessing reaction zone 4 includes plural reaction vessels each containing one or more catalyst beds, e.g., of different function.

Hydroprocessing zone 4 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 h-1 to 10 h-1. Notably, when using crude oil as a feedstock in the hydroprocessing zone advantages are demonstrated, for instance, as compared to the same hydroprocessing unit operation employed for atmospheric residue. For instance, at a start or run temperature in the range of 370° C. to 375° C. the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 while that for atmospheric residue is typically 0.25. An unexpected finding is that the deactivation rate when processing crude oil is going in the inverse direction from that which is usually observed. Deactivation at low throughput (0.25 hr') is 4.2° C./month and deactivation at higher throughput (0.5 $hr^{-1}$) is 2.0° C./month. With every feed which is considered in the industry, the opposite is observed. This can be attributed to the washing effect of the catalyst.

Reactor effluents 5 from the hydroprocessing zone 4 are cooled in an exchanger (not shown) and sent to a separators which may comprise a high pressure cold or hot separator 6. Separator tops 7 are cleaned in an amine unit 12 and the resulting hydrogen rich gas stream 13 is passed to a recycling compressor 14 to be used as a recycle gas 15 in the hydroprocessing reaction zone 4. Separator bottoms 8 from the high pressure separator 6, which are in a substantially liquid phase, are cooled and then introduced to a low pressure cold separator 9. Remaining gases, stream 11, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 11 (as indicated by dashed lines) with the cracking gas, stream 44, from the steam cracker products. The bottoms 10 from the low pressure separator 9 are optionally sent to steam pyrolysis zone 30.

The hydroprocessed effluent 10 contains a reduced content of contaminants (i.e., metals, sulfur and nitrogen), an increased paraffinicity, reduced BMCI, and an increased American Petroleum Institute (API) gravity.

The hydrotreated effluent 10 is passed to the convection section 32 and an effective amount of steam is introduced, e.g., admitted via a steam inlet (not shown). In the convection section 32 the mixture is heated to a predetermined temperature, e.g., using one or more waste heat streams or other suitable heating arrangement. The heated mixture of the pyrolysis feedstream and steam is passed to the pyrolysis section 34 to produce a mixed product stream 39. In certain embodiments the heated mixture from section 32 is passed through a vapor-liquid separation section 36 in which a portion 38 is rejected as a low sulfur fuel oil component suitable for blending with pyrolysis fuel oil 71.

The steam pyrolysis zone 30 operates under parameters effective to crack the hydrotreated effluent 10 into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the pyrolysis section in the range of from 0.05 seconds to 2 seconds.

Mixed product stream 39 is passed to the inlet of quenching zone 40 with a quenching solution 42 (e.g., water and/or pyrolysis fuel oil) introduced via a separate inlet to produce a quenched mixed product stream 44 having a reduced temperature, e.g., of about 300° C., and spent quenching solution 46 is recycled and/or purged.

The gas mixture effluent 39 from the cracker is typically a mixture of hydrogen, methane, hydrocarbons, carbon dioxide and hydrogen sulfide. After cooling with water and/or oil quench, mixture 44 is subjected to compression and separation. In one non-limiting example, stream 44 is compressed in a multi-stage compressor which typically comprises 4-6 stages, wherein said multi-stage compressor may comprise compressor zone 51 to produce a compressed gas mixture 52. The compressed gas mixture 52 may be treated in a caustic treatment unit 53 to produce a gas mixture 54 depleted of hydrogen sulfide and carbon dioxide. The gas mixture 54 may be further compressed in compressor zone 55. The resulting cracked gas 56 may undergo a cryogenic treatment in unit 57 to be dehydrated, and may be further dried by use of molecular sieves.

The cold cracked gas stream 58 from unit 57 may be passed to a de-methanizer tower 59, from which an overhead stream 60 is produced containing hydrogen and methane from the cracked gas stream. The bottoms stream 65 from de-methanizer tower 59 is then sent for further processing in product separation zone 70, comprising fractionation towers including de-ethanizer, de-propanizer and de-butanizer towers. Process configurations with a different sequence of de-methanizer, de-ethanizer, de-propanizer and de-butanizer can also be employed.

According to the processes herein described with reference to FIG. 1, after separation from methane at the de-methanizer tower 59 and hydrogen recovery in unit 61, hydrogen 62 having a purity of typically 80-95 vol % is obtained. Recovery methods in unit 61 include cryogenic recovery (e.g., at a temperature of about −157° C.). Hydrogen stream 62 is then passed to a hydrogen purification unit 64, such as a pressure swing adsorption (PSA) unit to obtain a hydrogen stream 2 having a purity of 99.9%+, or a membrane separation units to obtain a hydrogen stream 2 with a purity of about 95%. The purified hydrogen stream 2 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 63 can optionally be recycled to the steam cracker to be used as fuel for burners and/or heaters.

The bottoms stream 65 from de-methanizer tower 59 is conveyed to the inlet of product separation zone 70 to be separated into methane, ethylene, propylene, butadiene, mixed butylenes and pyrolysis gasoline via outlets 78, 77, 76, 75, 74 and 73, respectively. Pyrolysis gasoline generally includes C5-C9 hydrocarbons, and benzene, toluene and xylenes can be separated from this cut. Optionally one or both of the bottom asphalt phase 29 and the unvaporized heavy liquid fraction 38 from the vapor-liquid separation section 36 are combined with pyrolysis fuel oil 71 (e.g. materials boiling at a temperature higher than the boiling point of the lowest boiling C10 compound, known as a "C10+" stream) from separation zone 70, and the mixed stream is withdrawn as a pyrolysis fuel oil blend 72, e.g. to be further processed in an off-site refinery (not shown). In certain embodiments, the bottom asphalt phase 29 can be sent to an asphalt stripper (not shown) where any remaining solvent is stripped-off, e.g. by steam.

Another embodiment of the invention is shown with reference to embodiment 9 described above and with reference to FIG. 2. In the process of the present invention, the first solvent deasphalting zone allows to remove certain asphaltenes, metals and carbon residues from the heavy components with a relative high yield of first deasphalted and demetallized oil, but at the expense of a certain level of contamination. The subsequently produced hydroprocessed effluent is then processed in the second solvent deasphalting zone to remove the remaining asphaltenes, metals and carbon residues so that these are not subjected to thermal cracking. In one embodiment, the solvent used in the first solvent deasphalting zone is different than the solvent used in the second solvent deasphalting zone. Preferably, the solvent used in the first solvent deasphalting zone is pentane and the solvent used in the second solvent deasphalting zone is propane or butane. According to this preferred embodiment the integrated process further includes the steps of separating the second deasphalted and demetallized oil stream in a separation zone to recover a vapour portion that is sent to a steam pyrolysis zone, and a liquid portion, wherein the liquid portion is discharged and blended with pyrolysis fuel oil from the product separation zone as recited in step (f1). The thermal cracking step as discussed above preferably comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. It is preferred that the discharged liquid fraction is blended with pyrolysis fuel oil recovered in step (g1). In addition, it is also preferred that separating the heated hydroprocessed effluent into a vapor fraction and a liquid fraction is carried out with a vapor-liquid separation device based on physical and mechanical separation. Moreover, it is also preferred that the first solvent deasphalting zone and the second solvent deasphalting zone are combined in one single solvent deasphalting unit. The vapor-liquid separation device preferably includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Step (d1) in the integrated process preferably comprises compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e) and pyrolysis fuel oil as in step (f) from the remainder of the dehydrated compressed thermally cracked mixed product stream with a reduced content of hydrogen sulfide and carbon dioxide; and step (e) comprises purifying recovered hydrogen from the dehydrated compressed thermally cracked mixed product stream with a reduced content of hydrogen sulfide and carbon dioxide for recycle to the hydroprocessing zone.

Figure 2:
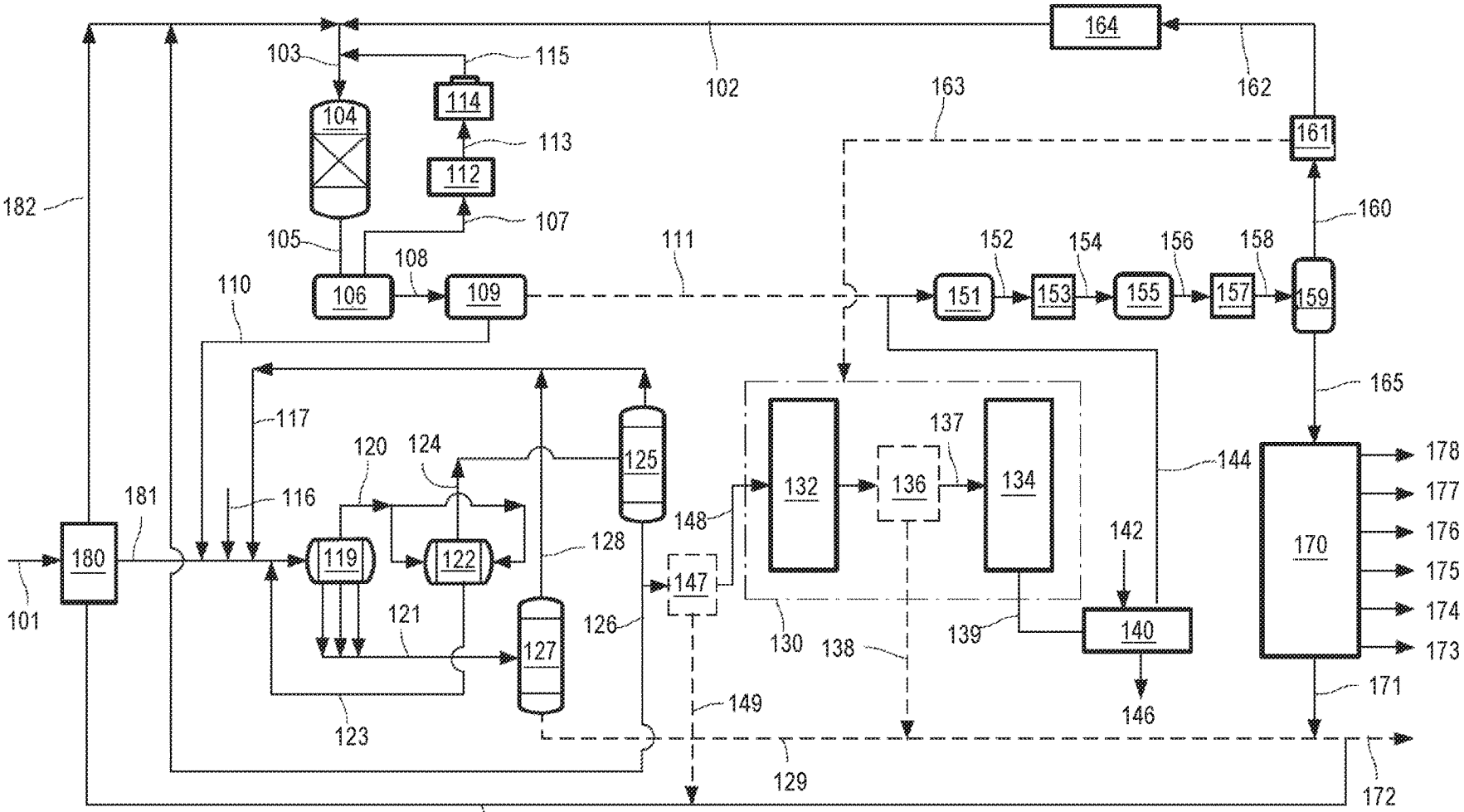
FIG. 2 is a flow diagram including an integrated solvent deasphalting, hydroprocessing and steam pyrolysis process and system including residual bypass.

This integrated process is preferably carried out wherein recovering hydrogen from the dehydrated compressed thermally cracked mixed product stream with a reduced content of hydrogen sulfide and carbon dioxide further comprises separately recovering methane for use as fuel for burners and/or heaters in the thermal cracking step. A flow diagram of an embodiment of the invention is shown in FIG. 2 including an integrated solvent deasphalting, hydroprocessing and steam pyrolysis process and system including residual bypass. The integrated system generally includes a feed separation zone, a solvent deasphalting zone, a selective catalytic hydroprocessing zone, a steam pyrolysis zone and a product separation zone. Feed separation zone 180 includes an inlet for receiving a feedstock stream 101, an outlet for discharging a rejected portion 183 and an outlet for discharging one or more remaining hydrocarbon portion 181, 182. Hydrocarbon portion 181 is sent to a solvent deasphalting zone. Hydrocarbon portion 182 is sent to a selective hydroprocessing zone. The cut point in separation zone 180 can be set so that it is compatible with the residue fuel oil blend, e.g., about 540° C. Separation zone 180 can be a single stage separation device such a flash separator. The cut point in separation zone 180 can be set so that there is only a separation into a rejected portion 183 and a remaining hydrocarbon portion 81, i.e. there is no remaining hydrocarbon portion 182.

The hydrocarbon fraction 182 can be mixed with an effective amount of hydrogen 102 and 115 (and if necessary a source of make-up hydrogen) and a solvent-free DA/DMO stream 126 to form a combined stream 103 and the admixture 103 is charged to the inlet of selective hydroprocessing reaction zone 104 at a temperature in the range of from 300° C. to 450° C.

In additional embodiments separation zone 180 can include, or consists essentially of (i.e., operate in the absence of a flash zone), a cyclonic phase separation device, or other separation device based on physical or mechanical separation of vapors and liquids. In embodiments in which the separation zone includes or consist essentially of a separation device based on physical or mechanical separation of vapors and liquids, the cut point can be adjusted based on vaporization temperature and the fluid velocity of the material entering the device.

The rejected portion 183 from the feed separation zone and optionally the unvaporized heavy liquid fraction 138 from the vapor-liquid separation section 136 are combined with pyrolysis fuel oil 171 (e.g., materials boiling at a temperature higher than the boiling point of the lowest boiling C10 compound, known as a "C10+" stream) from separation zone 170, and this is withdrawn as a pyrolysis fuel oil blend 172, e.g., to be further processed in an off-site refinery (not shown).

The selective hydroprocessing zone includes a reactor zone 104 including an inlet for receiving a combined stream 103 including a stream 182 and a stream 126 and hydrogen 102 recycled from the steam pyrolysis product stream, and make-up hydrogen if necessary (not shown). Reactor zone 104 also includes an outlet for discharging a hydroprocessed effluent 105.

Reactor effluents 105 from the hydroprocessing reactor(s) are cooled in a heat exchanger (not shown) and sent to a high pressure separator 106. The separator tops 107 are cleaned in an amine unit 112 and a resulting hydrogen rich gas stream 113 is passed to a recycling compressor 114 to be used as a recycle gas 115 in the hydroprocessing reactor. A bottoms stream 108 from the high pressure separator 106, which is in a substantially liquid phase, is cooled and introduced to a low pressure cold separator 109 in which it is separated into a gas stream 111 and a liquid stream 110. Gases from low pressure cold separator include hydrogen, $H_2S$, $NH_3$ and any light hydrocarbons such as C1-C4 hydrocarbons. Typically these gases are sent for further processing such as flare processing or fuel gas processing. According to certain embodiments herein, hydrogen is recovered by combining stream gas stream 111, which includes hydrogen, $H_2S$, $NH_3$ and any light hydrocarbons such as C1-C4 hydrocarbons, with steam cracker products 144. All or a portion of liquid stream 110 serves as the feed to the solvent deasphalting zone Solvent deasphalting zone generally includes a primary settler 119, a secondary settler 122, a solvent deasphalted/demetallized oil (DA/DMO) separation zone 125, and a separator zone 127. Primary settler 119 includes an inlet for receiving hydroprocessed effluent 110 and a solvent, which can be fresh solvent 116, recycle solvent 117, recycle solvent 128, or a combination of these solvent sources. Primary settler 119 also includes an outlet for discharging a primary DA/DMO phase 120 and several pipe outlets for discharging a primary asphalt phase 121. Secondary settler 122 includes two tee-type distributors located at both ends for receiving the primary DA/DMO phase 120, an outlet for discharging a secondary DA/DMO phase 124, and an outlet for discharging a secondary asphalt phase 123. DA/DMO separation zone 125 includes an inlet for receiving secondary DA/DMO phase 24, an outlet for discharging a solvent stream 117 and an outlet for discharging a solvent-free DA/DMO stream 126, which serves as the feed for the steam pyrolysis zone 130. Separator vessel 127 includes an inlet for receiving primary asphalt phase 121, an outlet for discharging a solvent stream 28, and an outlet for discharging a bottom asphalt phase 129, which can be blended with pyrolysis fuel oil 171 from the product separation zone 170.

Steam pyrolysis zone 130 generally comprises a convection section 132 and a pyrolysis section 134 that can operate based on steam pyrolysis unit operations known in the art, i.e., charging the thermal cracking feed to the convection section in presence of steam. In addition, in certain optional embodiments as described herein (as indicated with dashed lines in the sole figure), a vapor-liquid separation section 136 is included between sections 132 and 134. Vapor-liquid separation section 136, through which the heated steam cracking feed from the convection section 132 passes and is fractioned, can be a flash separation device, a separation device based on physical or mechanical separation of vapors and liquids or a combination including at least one of these types of devices. In additional optional embodiments, a vapor-liquid separation zone 147 is included upstream of sections 132, either in combination with a vapor-liquid separation zone 136 or in the absence of a vapor-liquid separation zone 136. Stream 126 is fractioned in separation zone 147, which can be a flash separation device, a separation device based on physical or mechanical separation of vapors and liquids or a combination including at least one of these types of devices.

In additional optional embodiments stream 126 is recycled to the inlet of the hydroprocessing zone 104.

A quenching zone 140 includes an inlet in fluid communication with the outlet of steam pyrolysis zone 130 for receiving mixed product stream 139, an inlet for admitting a quenching solution 142, an outlet for discharging an intermediate quenched mixed product stream 144 and an outlet for discharging quenching solution 146.

In general, an intermediate quenched mixed product stream 144 is subjected to separation in a compression and fractionation section. Such compression and fractionation section are well known in the art.

In a preferred embodiment, the mixed product stream 144 is converted into intermediate product stream 165 and hydrogen 162, which is purified in the present process and used as recycle hydrogen stream 102 in the hydroprocessing reaction zone 104. Intermediate product stream 165, which may further comprise hydrogen, is generally fractionated into end-products and residue in separation zone 170, which can one or multiple separation units such as plural fractionation towers including de-ethanizer, de-propanizer and de-butanizer towers, for example as is known to one of ordinary skill in the art.

In general product separation zone 170 includes an inlet in fluid communication with the product stream 165 and plural product outlets 173-178, including an outlet 178 for discharging methane that optionally may be combined with stream 163, an outlet 177 for discharging ethylene, an outlet 176 for discharging propylene, an outlet 175 for discharging butadiene, an outlet 174 for discharging mixed butylenes, and an outlet 173 for discharging pyrolysis gasoline. Additionally an outlet is provided for discharging pyrolysis fuel oil 171. Optionally, one or both of the bottom asphalt phase 129 from solvent deasphalting zone separator vessel 127 and the fuel oil portion 138 from vapor-liquid separation section 136 are combined with pyrolysis fuel oil 171 and the mixed stream can be withdrawn as a pyrolysis fuel oil blend 172, e.g., a low sulfur fuel oil blend to be further processed in an off-site refinery. Note that while six product outlets are shown, fewer or more can be provided depending, for instance, on the arrangement of separation units employed and the yield and distribution requirements.

In an embodiment of a process employing the arrangement shown in the sole figure, a solvent-free DA/DMO stream 126, and possibly a stream 182, is mixed with an effective amount of hydrogen 2 and 15 (and if necessary a source of make-up hydrogen) to form a combined stream 103. The admixture 103 is charged to the hydroprocessing reaction zone 104 at a temperature in the range of from 300° C. to 450° C. In certain embodiments, hydroprocessing reaction zone 104 includes one or more unit operations as described in United States Patent Publication Number 2011/0083996 and in PCT Patent Application Publication Numbers WO2010/009077, WO2010/009082, WO2010/009089 and WO2009/073436. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing zone 104 includes more than two catalyst beds. In further embodiments hydroprocessing reaction zone 4 includes plural reaction vessels each containing one or more catalyst beds, e.g., of different function.

Hydroprocessing zone 104 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$. Notably, using crude oil as a feedstock in the hydroprocessing zone 104 advantages are demonstrated, for instance, as compared to the same hydroprocessing unit operation employed for atmospheric residue. For instance, at a start or run temperature in the range of 370° C. to 375° C. the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 $hr^{-1}$ while that for atmospheric residue is typically 0.25 $h^{-1}$. An unexpected finding is that the deactivation rate when processing crude oil is going in the inverse direction from that which is usually observed. Deactivation at low throughput (0.25 $hr^{-1}$) is 4.2° C./month and deactivation at higher throughput (0.5 $hr^{-1}$) is 2.0° C./month. With every feed which is considered in the industry, the opposite is observed. This can be attributed to the washing effect of the catalyst.

Reactor effluents 105 from the hydroprocessing zone 104 are cooled in an exchanger (not shown) and sent to separators which may comprise a high pressure cold or hot separator 106. Separator tops 107 are cleaned in an amine unit 112 and the resulting hydrogen rich gas stream 113 is passed to a recycling compressor 114 to be used as a recycle gas 115 in the hydroprocessing reaction zone 104. Separator bottoms 108 from the high pressure separator 106, which are in a substantially liquid phase, are cooled and then introduced to a low pressure cold separator 109. Remaining gases, stream 111, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of this process, hydrogen, and optionally also C1-C4, is recovered by combining stream 111 (as indicated by dashed lines) with the cracking gas, stream 144, from the steam cracker products.

Hydroprocessed effluent 110 contains a reduced content of contaminants (i.e., metals, sulfur and nitrogen), an increased paraffinicity, reduced BMCI, and an increased American Petroleum Institute (API) gravity.

The hydrotreated effluent 110 is admixed with solvent from one or more sources 116, 117 and 128. The resulting mixture 118 is then transferred to the primary settler 119. By mixing and settling, two phases are formed in the primary settler 119: a primary DA/DMO phase 120 and a primary asphalt phase 121. The temperature of the primary settler 19 is sufficiently low to recover all DA/DMO from the feedstock. For instance, for a system using n-butane a suitable temperature range is about 60° C. to 150° C. and a suitable pressure range is such that it is higher than the vapor pressure of n-butane at the operating temperature e.g. about 15 to 25 bars to maintain the solvent in liquid phase. In a system using n-pentane a suitable temperature range is about 60° C. to about 180° C. and again a suitable pressure range is such that it is higher than the vapor pressure of n-pentane at the operating temperature e.g. about 10 to 25 bars to maintain the solvent in liquid phase. The temperature in the second settler is usually higher than the one in the first settler.

The primary DA/DMO phase 120 including a majority of solvent and DA/DMO with a minor amount of asphalt is discharged via the outlet located at the top of the primary settler 119 and collector pipes (not shown). The primary asphalt phase 121, which contains 20-50% by volume of solvent, is discharged via several pipe outlets located at the bottom of the primary settler 19.

The primary DA/DMO phase 120 enters into the two tee-type distributors at both ends of the secondary settler 122 which serves as the final stage for the extraction. A secondary asphalt phase 123 containing a small amount of solvent and DA/DMO is discharged from the secondary settler 122 and recycled back to the primary settler 119 to recover DA/DMO. A secondary DA/DMO phase 124 is obtained and passed to the DA/DMO separation zone 125 to obtain a solvent stream 117 and a solvent-free DA/DMO stream 26. Greater than 90 wt. % of the solvent charged to the settlers enters the DA/DMO separation zone 125, which is dimensioned to permit a rapid and efficient flash separation of solvent from the DA/DMO. The primary asphalt phase 121 is conveyed to the separator vessel 127 for flash separation of a solvent stream 128 and a bottom asphalt phase 129. Solvent streams 117 and 128 can be used as solvent for the primary settler 119, therefore minimizing the fresh solvent 116 requirement.

The solvents used in solvent deasphalting zone include pure liquid hydrocarbons such as propane, butanes and pentanes, as well as their mixtures. The selection of solvents depends on the requirement of DAO, as well as the quality and quantity of the final products. The operating conditions for the solvent deasphalting zone include a temperature at or below critical point of the solvent; a solvent-to-oil ratio in the range of from 2:1 to 50:1 (vol.:vol.); and a pressure in a range effective to maintain the solvent/feed mixture in the settlers is in the liquid state.

The essentially solvent-free DA/DMO stream 126 is optionally steam stripped (not shown) to remove solvent. In certain embodiments the deasphalted and demetallized oil stream 126 is the feed 148 to the steam pyrolysis zone 130. In further embodiments, deasphalted and demetallized oil stream 126 is sent to separation zone 147 wherein the discharged vapor portion is the feed 148 to the steam pyrolysis zone 130. The vapor portion can have, for instance, an initial boiling point corresponding to that of the deasphalted and demetallized oil stream 126 and a final boiling point in the range of about 370° C. to about 600° C. Separation zone 147 can include a suitable vapor-liquid separation unit operation such as a flash vessel, a separation device based on physical or mechanical separation of vapors and liquids or a combination including at least one of these types of devices.

The feed 148 is conveyed to the convection section 132 in the presence of a predetermined amount of steam, e.g., admitted via a steam inlet (not shown). In the convection section 132 the mixture is heated to a predetermined temperature, e.g., using one or more waste heat streams or other suitable heating arrangement. The heated mixture of the pyrolysis feedstream and additional steam is passed to the pyrolysis section 134 to produce a mixed product stream 139. In certain embodiments the heated mixture from section 132 is passed through a vapor-liquid separation section 136 in which a portion 138 is rejected as a low sulfur fuel oil component suitable for blending with pyrolysis fuel oil 171.

The steam pyrolysis zone 130 operates under parameters effective to crack the DA/DMO stream into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection zone in the range of from 0.3:1 to 2:1 (wt.:wt.); and a residence time in the pyrolysis section in the range of from 0.05 seconds to 2 seconds.

Mixed product stream 139 is passed to the inlet of quenching zone 140 with a quenching solution 142 (e.g., water and/or pyrolysis fuel oil) introduced via a separate inlet to produce a quenched mixed product stream 144 having a reduced temperature, e.g., of about 300° C., and spent quenching solution 146 is recycled and/or purged.

The gas mixture effluent 139 from the cracker is typically a mixture of hydrogen, methane, hydrocarbons, carbon dioxide and hydrogen sulfide. After cooling with water and/or oil quench, mixture 144 is subjected to compression and separation. In one non-limiting example, stream 144 is compressed in a multi-stage compressor which typically comprises 4-6 stages, wherein said multi-stage compressor may comprise compressor zone 151, to produce a compressed gas mixture 152. The compressed gas mixture 152 may be treated in a caustic treatment unit 153 to produce a gas mixture 154 depleted of hydrogen sulfide and carbon dioxide. The gas mixture 154 may be further compressed in a compressor zone 155. The resulting cracked gas 156 may undergo a cryogenic treatment in unit 157 to be dehydrated, and may be further dried by use of molecular sieves.

The cold cracked gas stream 158 from unit 157 may be passed to a de-methanizer tower 159, from which an overhead stream 160 is produced containing hydrogen and methane from the cracked gas stream. The bottoms stream 165 from de-methanizer tower 159 is then sent for further processing in product separation zone 170, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 159 and hydrogen recovery in unit 161, hydrogen 162 having a purity of typically 80-95 vol. % is obtained. Recovery methods in unit 161 include cryogenic recovery (e.g., at a temperature of about −157° C.). Hydrogen stream 162 is then passed to a hydrogen purification unit 164, such as a pressure swing adsorption (PSA) unit to obtain a hydrogen stream 102 having a purity of 99.9%+, or a membrane separation units to obtain a hydrogen stream 102 with a purity of about 95%. The purified hydrogen stream 102 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 163 can optionally be recycled to the steam cracker to be used as fuel for burners and/or heaters.

The bottoms stream 165 from de-methanizer tower 159 is conveyed to the inlet of product separation zone 170 to be separated into methane, ethylene, propylene, butadiene, mixed butylenes and pyrolysis gasoline via outlets 178, 177, 176, 175, 174 and 173, respectively. Pyrolysis gasoline generally includes C5-C9 hydrocarbons, and benzene, toluene and xylenes can be separated from this cut. Optionally, one or both of the bottom asphalt phase 129 and the unvaporized heavy liquid fraction 38 from the vapor-liquid separation section 136 are combined with pyrolysis fuel oil 171 (e.g., materials boiling at a temperature higher than the boiling point of the lowest boiling C10 compound, known as a "C10+" stream) from separation zone 170, and the mixed stream is withdrawn as a pyrolysis fuel oil blend 172, e.g., to be further processed in an off-site refinery (not shown). In certain embodiments, the bottom asphalt phase 129 can be sent to an asphalt stripper (not shown) where any remaining solvent is stripped-off, e.g. by steam.

Figure 3:
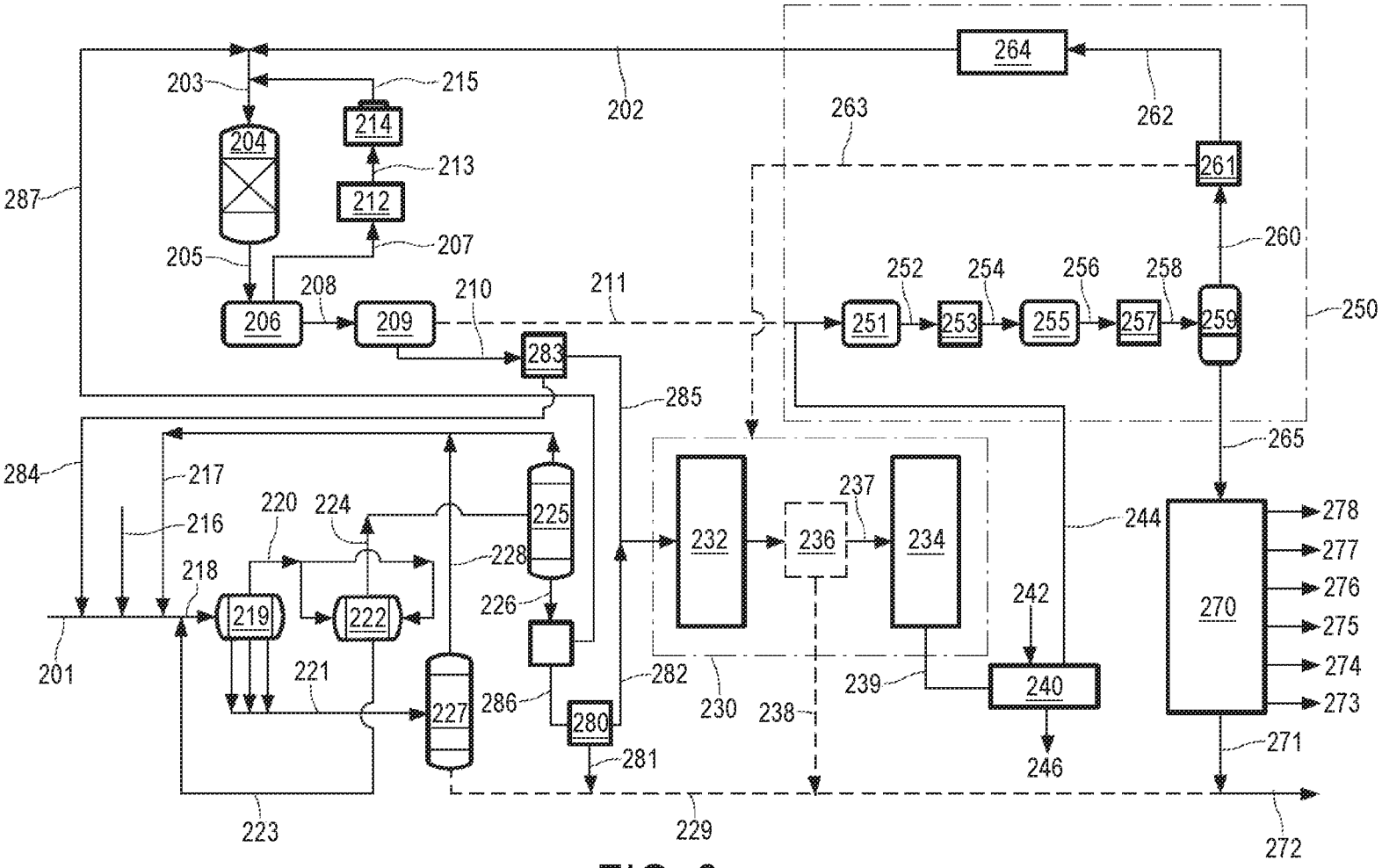
FIG. 3 is a process flow diagram of an embodiment of an integrated process according to the invention.

In the process of the present invention as described in embodiment 17 and shown in FIG. 3, the first solvent deasphalting zone allows to remove certain asphaltenes, metals and carbon residues from the heavy components with a relative high yield of first deasphalted and demetallized oil, but at the expense of a certain level of contamination. The subsequently produced hydroprocessed effluent is then processed in the second solvent deasphalting zone to remove the remaining asphaltenes, metals and carbon residues so that these are not subjected to thermal cracking. In one embodiment, the solvent used in the first solvent deasphalting zone is different than the solvent used in the second solvent deasphalting zone. Preferably, the solvent used in the first solvent deasphalting zone is pentane and the solvent used in the second solvent deasphalting zone is propane or butane. This integrated process further comprises separating the deasphalted and demetallized oil stream in a separation zone to recover a vapour portion that is sent to a steam pyrolysis zone, and a liquid portion, wherein the liquid portion is discharged and blended with pyrolysis fuel oil from the product separation zone as recited in step (e3). According to a preferred embodiment of this method the thermal cracking step comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. Moreover, it is also preferred that the first solvent deasphalting zone and the second solvent deasphalting zone are combined in one single solvent deasphalting unit. It is preferred when the discharged liquid fraction is blended with pyrolysis fuel oil recovered in step (g3). The separation of the heated hydroprocessed effluent into a vapor fraction and a liquid fraction is preferably carried out with a vapor-liquid separation device based on physical and mechanical separation. Such a vapor-liquid separation device preferably includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Step (d3) of the integrated process according to this process preferably further comprises compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e3) and pyrolysis fuel oil as in step (f3) from the remainder of the dehydrated compressed thermally cracked mixed product stream with a reduced content of hydrogen sulfide and carbon dioxide; and step (e3) preferably comprises purifying recovered hydrogen from the dehydrated compressed thermally cracked mixed product stream with a reduced content of hydrogen sulfide and carbon dioxide for recycle to the hydroprocessing zone. A preferred embodiment of this integrated process includes a step of recovering hydrogen from the dehydrated compressed thermally cracked mixed product stream with a reduced content of hydrogen sulfide and carbon dioxide further comprises separately recovering methane for use as fuel for burners and/or heaters in the thermal cracking step.

The invention will be described in further detail below and with reference FIG. 3. A flow diagram including an integrated solvent deasphalting, hydroprocessing and steam pyrolysis process and system including residual bypass is shown in FIG. 3. The integrated system generally includes a solvent deasphalting zone, a selective catalytic hydroprocessing zone, a steam pyrolysis zone and a product separation zone. Solvent deasphalting zone includes a primary settler 219, a secondary settler 222, a deasphalted/demetallized oil (DA/DMO) separation zone 225, and a separator zone 227. Primary settler 219 includes an inlet for receiving a combined stream 218 including a feed stream 201 and a solvent, which can be fresh solvent 216, recycle solvent 217, recycle solvent 228, or a combination of these solvent sources. Primary settler 219 also includes an outlet for discharging a primary DA/DMO phase 220 and several pipe outlets for discharging a primary asphalt phase 221. Secondary settler 222 includes two tee-type distributors located at both ends for receiving the primary DA/DMO phase 220, an outlet for discharging a secondary DA/DMO phase 224, and an outlet for discharging a secondary asphalt phase 223. DA/DMO separation zone 225 includes an inlet for receiving secondary DA/DMO phase 224, an outlet for discharging a solvent stream 217 and an outlet for discharging a solvent-free DA/DMO stream 226, which serves as the feed for the selective hydroprocessing zone. Stream 226 can be further separated in separator 288 into a stream 286 and a stream 287, wherein stream 287 serves as the feed for the selective hydroprocessing zone. Stream 286 can be further separated in a separator 280 into a stream 282 and stream 281, wherein stream 282 serves as a feed for the steam pyrolysis zone 230, especially the convection section 232. In a preferred alternative, stream 226 is separated in separator 288 into a stream 281 and a stream 286, wherein said stream 286 serves as a feed for separator 280 into a stream 282 and a stream 287, wherein stream 282 serves as a feed for the steam pyrolysis zone 230, especially the convection section 32 and stream 87 serves as the feed for the selective hydroprocessing zone. Separator vessel 227 includes an inlet for receiving primary asphalt phase 221, an outlet for discharging a solvent stream 228, and an outlet for discharging a bottom asphalt phase 229, which can be blended with pyrolysis fuel oil 271 from the product separation zone 270 and with stream 81 from the separator 280.

The selective hydroprocessing zone includes a reactor zone 204 includes an inlet for receiving a mixture of the solvent-free DA/DMO stream 226 and hydrogen 202 recycled from the steam pyrolysis product stream, and make-up hydrogen if necessary (not shown). Reactor zone 204 further includes an outlet for discharging a hydroprocessed effluent 205.

Reactor effluents 205 from the hydroprocessing reactor(s) are cooled in a heat exchanger (not shown) and sent to a high pressure separator 206. The separator tops 207 are cleaned in an amine unit 212 and a resulting hydrogen rich gas stream 213 is passed to a recycling compressor 214 to be used as a recycle gas 215 in the hydroprocessing reactor. A bottoms stream 208 from the high pressure separator 206, which is in a substantially liquid phase, is cooled and introduced to a low pressure cold separator 209 in which it is separated into a gas stream and a liquid stream 210. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments herein, hydrogen is recovered by combining stream gas stream 211, which includes hydrogen, $H_2S$, $NH_3$ and any light hydrocarbons such as C1-C4 hydrocarbons, with steam cracker products 244. Liquid stream 210 can directly serve as the feed to the steam pyrolysis zone 230.

In a preferred embodiment liquid stream 210 is separated in separation unit 283 into a stream 285 and a stream 284, wherein stream 85 is sent to the steam pyrolysis zone 230 and stream 284 is used as an additional feed to the inlet of the solvent deasphalting zone, as discussed before. This means that the liquid stream 210, which stream 210 has already been processed in a solvent deasphalting zone and in a selective hydroprocessing zone, will be treated again in a solvent deasphalting zone. The flow diagram according to FIG. 3 shows only one solvent deasphalting zone but in practice two different solvent deasphalting zones can be operated as well.

Steam pyrolysis zone 230 generally comprises a convection section 232 and a pyrolysis section 234 that can operate based on steam pyrolysis unit operations known in the art, i.e., charging the thermal cracking feed to the convection section in the presence of steam. In addition, in certain optional embodiments as described herein (as indicated with dashed lines in FIG. 3), a vapor-liquid separation section 236 is included between sections 232 and 234. Vapor-liquid separation section 236, through which the heated steam cracking feed from convection section 232 passes, can be a separation device based on physical or mechanical separation of vapors and liquids.

A quenching zone 240 includes an inlet in fluid communication with the outlet of steam pyrolysis zone 230, an inlet for admitting a quenching solution 242, an outlet for discharging the quenched mixed product stream 244 and an outlet for discharging quenching solution 246.

In general, an intermediate quenched mixed product stream 244 is subjected to separation in a compression and fractionation section. Such compression and fractionation section are well known in the art.

In one embodiment, the mixed product stream 244 is converted into intermediate product stream 265 and hydrogen 262, which is purified in the present process and used as recycle hydrogen stream 202 in the hydroprocessing reaction zone 24. Intermediate product stream 265, which may further comprise hydrogen, is generally fractioned into end-products and residue in separation zone 270, which can include one or multiple separation units, for example as is known to one of ordinary skill in the art.

In general product separation zone 270 includes an inlet in fluid communication with the product stream 265 and plural product outlets 273-278, including an outlet 278 for discharging methane that optionally may be combined with stream 263, an outlet 277 for discharging ethylene, an outlet 76 for discharging propylene, an outlet 275 for discharging butadiene, an outlet 274 for discharging mixed butylenes, and an outlet 273 for discharging pyrolysis gasoline. Additionally an outlet is provided for discharging pyrolysis fuel oil 271. Optionally, one or both of the bottom asphalt phase 229 from separator vessel 227 and the rejected portion 238 from vapor-liquid separation section 236 are combined with pyrolysis fuel oil 271 and the mixed stream can be withdrawn as a pyrolysis fuel oil blend 272, e.g., a low sulfur fuel oil blend to be further processed in an off-site refinery. Note that while six product outlets are shown, fewer or more can be provided depending, for instance, on the arrangement of separation units employed and the yield and distribution requirements.

In an embodiment of a process employing the arrangement shown in FIG. 3, a crude oil feedstock 201 is admixed with solvent from one or more sources 216, 217, 284 and 228. The resulting mixture 218 is then transferred to the primary settler 219. By mixing and settling, two phases are formed in the primary settler 219: a primary DA/DMO phase 220 and a primary asphalt phase 221. The temperature of the primary settler 19 is sufficiently low to recover all DA/DMO from the feedstock. For instance, for a system using n-butane a suitable temperature range is about 60° C. to 150° C. and a suitable pressure range is such that it is higher than the vapor pressure of n-butane at the operating temperature e.g. about 15 to 25 bars to maintain the solvent in liquid phase. In a system using n-pentane a suitable temperature range is about 60° C. to about 180° C. and again a suitable pressure range is such that it is higher than the vapor pressure of n-pentane at the operating temperature e.g. about 10 to 25 bars to maintain the solvent in liquid phase. The temperature in the second settler is usually higher than the one in the first settler.

The primary DA/DMO phase 220 including a majority of solvent and DA/DMO with a minor amount of asphalt is discharged via the outlet located at the top of the primary settler 219 and collector pipes (not shown). The primary asphalt phase 221, which contains 40-50% by volume of solvent, is discharged via several pipe outlets located at the bottom of the primary settler 219.

The primary DA/DMO phase 220 enters into the two tee-type distributors at both ends of the secondary settler 222 which serves as the final stage for the extraction. A secondary asphalt phase 223 containing a small amount of solvent and DA/DMO is discharged from the secondary settler 222 and recycled back to the primary settler 219 to recover DA/DMO. A secondary DA/DMO phase 224 is obtained and passed to the DA/DMO separation zone 225 to obtain a solvent stream 217 and a solvent-free DA/DMO stream 226. Greater than 90 wt. % of the solvent charged to the settlers enters the DA/DMO separation zone 225, which is dimensioned to permit a rapid and efficient flash separation of solvent from the DA/DMO. The primary asphalt phase 221 is conveyed to the separator vessel 227 for flash separation of a solvent stream 228 and a bottom asphalt phase 229. Solvent streams 217 and 228 can be used as solvent for the primary settler 219, therefore minimizing the fresh solvent 216 requirement. The solvents used in solvent deasphalting zone include pure liquid hydrocarbons such as propane, butanes and pentanes, as well as their mixtures. The selection of solvents depends on the requirement of DAO, as well as the quality and quantity of the final products. The operating conditions for the solvent deasphalting zone include a temperature at or below critical point of the solvent; a solvent-to-oil ratio in the range of from 2:1 to 50:1; and a pressure in a range effective to maintain the solvent/feed mixture in the settlers is in the liquid state.

The essentially solvent-free DA/DMO stream 226 is optionally steam stripped (not shown) to remove any remaining solvent, and mixed with an effective amount of hydrogen and stream 215 (and if necessary a source of make-up hydrogen) to form a combined stream 203. The admixture 203 is charged to the hydroprocessing reaction zone 204 at a temperature in the range of from 300° C. to 450° C. In certain embodiments, hydroprocessing reaction zone 204 includes one or more unit operations as described in United States Patent Publication Number 2011/0083996 and in PCT Patent Application Publication Numbers WO2010/009077, WO2010/009082, WO2010/009089 and WO2009/073436. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing reaction zone 204 includes more than two catalyst beds. In further embodiments hydroprocessing reaction zone 204 includes plural reaction vessels each containing one or more catalyst beds, e.g., of different function.

In another embodiment stream 226 is further separated into a stream 286 and a stream 287, wherein stream 287 is mixed with an effective amount of hydrogen and 215 (and if necessary a source of make-up hydrogen) to form a combined stream 203.

Stream 286 can be further separated in unit 280 into a stream 281 and a stream 282, wherein stream 282 is sent to the steam pyrolysis zone 230. The feed to steam pyrolysis zone 230 can thus be a combination of stream 285 and stream 282.

Hydroprocessing zone 204 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $hr^{-1}$ to 10 $hr^{-1}$. Notably, using crude oil as a feedstock in the hydroprocessing zone 204 advantages are demonstrated, for instance, as compared to the same hydroprocessing unit operation employed for atmospheric residue. For instance, at a start or run temperature in the range of 370° C. to 375° C. the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars.

Additionally to achieve the high level of saturation required for the increase in the hydrogen content of the feed, this process can be operated at a high throughput when compared to atmospheric residue. The LHSV can be as high as 0.5 while that for atmospheric residue is typically 0.25. An unexpected finding is that the deactivation rate when processing crude oil is going in the inverse direction from that which is usually observed. Deactivation at low throughput (0.25 $hr^{-1}$) is 4.2° C./month and deactivation at higher throughput (0.5 $hr^{-1}$) is 2.0° C./month. With every feed which is considered in the industry, the opposite is observed. This can be attributed to the washing effect of the catalyst.

Reactor effluents 205 from the hydroprocessing zone 204 are cooled in an exchanger (not shown) and sent to a high pressure cold or hot separator 206. Separator tops 207 are cleaned in an amine unit 212 and the resulting hydrogen rich gas stream 213 is passed to a recycling compressor 214 to be used as a recycle gas 215 in the hydroprocessing reaction zone 204. Separator bottoms 208 from the high pressure separator 6, which are in a substantially liquid phase, are cooled and then introduced to a low pressure cold separator 209. Remaining gases, stream 211, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 211 (as indicated by dashed lines) with the cracking gas, stream 244, from the steam cracker products. The bottoms 210 from the low pressure separator 209 are optionally sent to separation zone 220 or passed directly to steam pyrolysis zone 230.

The hydroprocessed effluent 210 contains a reduced content of contaminants (i.e., metals, sulfur and nitrogen), an increased paraffinicity, reduced BMCI, and an increased American Petroleum Institute (API) gravity.

The hydrotreated effluent 210 can be passed directly to the convection section 232 and an effective amount of steam is introduced, e.g., admitted via a steam inlet (not shown). In another embodiment hydrotreated effluent 210 is separated in separator 283 into a stream 285 and a stream 284, wherein stream 285 is passed to the convection section 232 in the presence of an effective amount of steam, e.g., admitted via a steam inlet (not shown). In addition, the feed to the convection section 232 may also comprise a stream 282 from separator 280.

As shown in the FIG. 3 stream 282 serves as a feed for convection section 232 as well.

In the convection section 232 the mixture is heated to a predetermined temperature, e.g., using one or more waste heat streams or other suitable heating arrangement. The heated mixture of the pyrolysis feedstream and additional steam is passed to the pyrolysis section 234 to produce a mixed product stream 239. In certain embodiments the heated mixture of from section 232 is passed through a vapor-liquid separation section 236 in which a portion 238 is rejected as a low sulfur fuel oil component suitable for blending with pyrolysis fuel oil 271.

The steam pyrolysis zone 230 operates under parameters effective to crack the hydrotreated effluent 210 into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection section in the range of from 0.3:1 to 2:1; and a residence time in the pyrolysis section in the range of from 0.05 seconds to 2 seconds.

Mixed product stream 239 is passed to the inlet of quenching zone 240 with a quenching solution 242 (e.g., water and/or pyrolysis fuel oil) introduced via a separate inlet to produce a quenched mixed product stream 244 having a reduced temperature, e.g., of about 300° C., and spent quenching solution 246 is recycled and/or purged.

The gas mixture effluent 239 from the cracker is typically a mixture of hydrogen, methane, hydrocarbons, carbon dioxide and hydrogen sulfide. After cooling with water and/or oil quench, mixture 244 is subjected to compression and separation. In one non-limiting example, stream 244 is compressed in a multi-stage compressor zone 251, to produce a compressed gas mixture 252. The compressed gas mixture 252 may be treated in a caustic treatment unit 253 to produce a gas mixture 254 depleted of hydrogen sulfide and carbon dioxide. The gas mixture 254 may be further compressed in a compressor zone 255. The resulting cracked gas 256 may undergo a cryogenic treatment in unit 257 to be dehydrated, and may be further dried by use of molecular sieves.

The cold cracked gas stream 258 from unit 257 may be passed to a de-methanizer tower 259, from which an overhead stream 260 is produced containing hydrogen and methane from the cracked gas stream. The bottoms stream 265 from de-methanizer tower 59 is then sent for further processing in product separation zone 270, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 259 and hydrogen recovery in unit 261, hydrogen 262 having a purity of typically 80-95 vol % is obtained. Recovery methods in unit 261 include cryogenic recovery (e.g., at a temperature of about −157° C.). Hydrogen stream 262 is then passed to a hydrogen purification unit 264, such as a pressure swing adsorption (PSA) unit to obtain a hydrogen stream 202 having a purity of 99.9%+, or a membrane separation units to obtain a hydrogen stream 202 with a purity of about 95%. The purified hydrogen stream 202 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 263 can optionally be recycled to the steam cracker to be used as fuel for burners and/or heaters.

The bottoms stream 265 from de-methanizer tower 259 is conveyed to the inlet of product separation zone 270 to be separated into methane, ethylene, propylene, butadiene, mixed butylenes and pyrolysis gasoline via outlets 278, 277, 276, 275, 274 and 273, respectively. Pyrolysis gasoline generally includes C5-C9 hydrocarbons, and benzene, toluene and xylenes may be separated from this cut. Optionally one or both of the bottom asphalt phase 229 and the unvaporized heavy liquid fraction 238 from the vapor-liquid separation section 236 are combined with pyrolysis fuel oil 271 (e.g., materials boiling at a temperature higher than the boiling point of the lowest boiling C10 compound, known as a "C10+" stream) from separation zone 270, and the mixed stream is withdrawn as a pyrolysis fuel oil blend 272, e.g., to be further processed in an off-site refinery (not shown). In certain embodiments, the bottom asphalt phase 229 can be sent to an asphalt stripper (not shown) where any remaining solvent is stripped-off, e.g. by steam.

The present inventors have also found that is beneficial to apply hydrotreating and solvent deasphalting only to that part of the crude oil that benefits from it. This means that the non-upgradable crude oil fractions are discharged. The integrated process of embodiment 25 as described above preferably comprises separating the deasphalted and demetallized oil stream in a separation zone to recover a vapor portion that is sent to a steam pyrolysis zone, and a liquid portion, wherein the liquid portion is discharged and blended with pyrolysis fuel oil from the product separation zone as recited in step (e4) of embodiment 25 as described above. Thus, according to a preferred embodiment of the invention according to embodiment 25 the thermal cracking step comprises heating hydroprocessed effluent in a convection section of a steam pyrolysis zone, separating the heated hydroprocessed effluent into a vapor fraction and a liquid fraction, passing the vapor fraction to a pyrolysis section of a steam pyrolysis zone, and discharging the liquid fraction. It is preferred when the discharged liquid fraction is blended with pyrolysis fuel oil recovered in step (g4). The separation of the heated hydroprocessed effluent into a vapor fraction and a liquid fraction is preferably carried out with a vapor-liquid separation device based on physical and mechanical separation. Such a vapor-liquid separation device preferably includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes. Step (d4) of the integrated process according to the present invention preferably comprises compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (e4) and pyrolysis fuel oil as in step (f4) from the remainder of the dehydrated compressed thermally cracked mixed product stream with a reduced content of hydrogen sulfide and carbon dioxide. Step (e4) preferably comprises purifying recovered hydrogen from the dehydrated compressed thermally cracked mixed product stream with a reduced content of hydrogen sulfide and carbon dioxide for recycle to the hydroprocessing zone. According to a preferred embodiment of the present integrated process further includes a step of recovering hydrogen from the dehydrated compressed thermally cracked mixed product stream with a reduced content of hydrogen sulfide and carbon dioxide further comprises separately recovering methane for use as fuel for burners and/or heaters in the thermal cracking step. The invention will be described in further detail below and with reference to FIG. 4, which is a process flow diagram of an embodiment of the invention including an integrated separation, hydrotreating, solvent deasphalting and steam pyrolysis process and system.

This system includes an initial feed separation zone, a selective hydroprocessing zone, a solvent deasphalting zone, a steam pyrolysis zone and a product separation zone. Feed separation zone 380 includes an inlet for receiving a feedstock stream 301, an outlet for discharging a rejected portion 383 and an outlet for discharging one or more remaining hydrocarbon portions 382. Hydrocarbon portion 383 is mixed with one or more streams, such as streams 329, 349, 338 and 371. Hydrocarbon portion 382 is sent to a selective hydroprocessing zone. The cut point in separation zone 380 can be set so that it is compatible with the residue fuel oil blend, e.g., about 540° C. Separation zone 380 can be a single stage separation device such a flash separator. The cut point in separation zone 380 can be set so that there is only a separation into a rejected portion 83 and one remaining hydrocarbon portion 382.

In additional embodiments separation zone 380 can include, or consists essentially of (i.e., operate in the absence of a flash zone), a cyclonic phase separation device, or other separation device based on physical or mechanical separation of vapors and liquids. In embodiments in which the separation zone includes or consist essentially of a separation device based on physical or mechanical separation of vapors and liquids, the cut point can be adjusted based on vaporization temperature and the fluid velocity of the material entering the device.

The selective hydroprocessing zone includes a reactor zone 304 including an inlet for receiving a combined stream 303 including a feed stream 382 originating from separator 380 and hydrogen 302 recycled from the steam pyrolysis product stream, and make-up hydrogen if necessary (not shown). Reactor zone 304 also includes an outlet for discharging a hydroprocessed effluent 305.

Reactor effluents 305 from the hydroprocessing reactor(s) are cooled in a heat exchanger (not shown) and sent to a high pressure separator 306. The separator tops 307 are cleaned in an amine unit 312 and a resulting hydrogen rich gas stream 313 is passed to a recycling compressor 314 to be used as a recycle gas 315 in the hydroprocessing reactor. A bottoms stream 308 from the high pressure separator 306, which is in a substantially liquid phase, is cooled and introduced to a low pressure cold separator 309 in which it is separated into a gas stream 311 and a liquid stream 310. Gases from low pressure cold separator includes hydrogen, $H_2S$, $NH_3$ and any light hydrocarbons such as C1-C4 hydrocarbons. Typically these gases are sent for further processing such as flare processing or fuel gas processing. According to certain embodiments herein, hydrogen is recovered by combining stream gas stream 311, which includes hydrogen, $H_2S$, $NH_3$ and any light hydrocarbons such as C1-C4 hydrocarbons, with steam cracker products 344. All or a portion of liquid stream 310 serves as the feed to the solvent deasphalting zone Solvent deasphalting zone generally includes a primary settler 319, a secondary settler 322, a solvent deasphalted/demetallized oil (DA/DMO) separation zone 325, and a separator zone 327. Primary settler 319 includes an inlet for receiving hydroprocessed effluent 310 and a solvent, which can be fresh solvent 316, recycle solvent 317, recycle solvent 328, or a combination of these solvent sources. Primary settler 319 also includes an outlet for discharging a primary DA/DMO phase 320 and several pipe outlets for discharging a primary asphalt phase 321. Secondary settler 322 includes two tee-type distributors located at both ends for receiving the primary DA/DMO phase 320, an outlet for discharging a secondary DA/DMO phase 324, and an outlet for discharging a secondary asphalt phase 323. DA/DMO separation zone 325 includes an inlet for receiving secondary DA/DMO phase 324, an outlet for discharging a solvent stream 317 and an outlet for discharging a solvent-free DA/DMO stream 326, which serves as the feed for the steam pyrolysis zone 330. Separator vessel 327 includes an inlet for receiving primary asphalt phase 321, an outlet for discharging a solvent stream 328, and an outlet for discharging a bottom asphalt phase 329, which can be blended with pyrolysis fuel oil 371 from the product separation zone 370.

Steam pyrolysis zone 330 generally comprises a convection section 332 and a pyrolysis section 334 that can operate based on steam pyrolysis unit operations known in the art, i.e., charging the thermal cracking feed to the convection section in presence of steam. In addition, in certain optional embodiments as described herein (as indicated with dashed lines in FIG. 4), a vapor-liquid separation section 336 is included between sections 332 and 334. Vapor-liquid separation section 336, through which the heated steam cracking feed from the convection section 332 passes and is fractioned, can be a flash separation device, a separation device based on physical or mechanical separation of vapors and liquids or a combination including at least one of these types of devices. In additional optional embodiments, a vapor-liquid separation zone 347 is included upstream of sections 332, either in combination with a vapor-liquid separation zone 336 or in the absence of a vapor-liquid separation zone 336. Stream 326 is fractioned in separation zone 347, which can be a flash separation device, a separation device based on physical or mechanical separation of vapors and liquids or a combination including at least one of these types of devices.

A quenching zone 340 includes an inlet in fluid communication with the outlet of steam pyrolysis zone 330 for receiving mixed product stream 339, an inlet for admitting a quenching solution 342, an outlet for discharging an intermediate quenched mixed product stream 344 and an outlet for discharging quenching solution 346.

In general, an intermediate quenched mixed product stream 344 is subjected to separation in a compression and fractionation section. Such compression and fractionation section are well known in the art.

In one embodiment, the mixed product stream 344 is converted into intermediate product stream 365 and hydrogen 362, which is purified in the present process and used as recycle hydrogen stream 302 in the hydroprocessing reaction zone 304. Intermediate product stream 365, which may further comprise hydrogen, is generally fractioned into end-products and residue in separation zone 370, which can one or multiple separation units such as plural fractionation towers including de-ethanizer, de-propanizer and de-butanizer towers, for example as is known to one of ordinary skill in the art.

In general product separation zone 370 includes an inlet in fluid communication with the product stream 365 and plural product outlets 373-378, including an outlet 378 for discharging methane that optionally may be combined with stream 363, an outlet 377 for discharging ethylene, an outlet 376 for discharging propylene, an outlet 375 for discharging butadiene, an outlet 374 for discharging mixed butylenes, and an outlet 373 for discharging pyrolysis gasoline. Additionally an outlet is provided for discharging pyrolysis fuel oil 371. Optionally, one or both of the bottom asphalt phase 329 from solvent deasphalting zone separator vessel 327 and the fuel oil portion 338 from vapor-liquid separation section 36 are combined with pyrolysis fuel oil 371 and the mixed stream can be withdrawn as a pyrolysis fuel oil blend 372, e.g., a low sulfur fuel oil blend to be further processed in an off-site refinery. Note that while six product outlets are shown, fewer or more can be provided depending, for instance, on the arrangement of separation units employed and the yield and distribution requirements.

Figure 4:
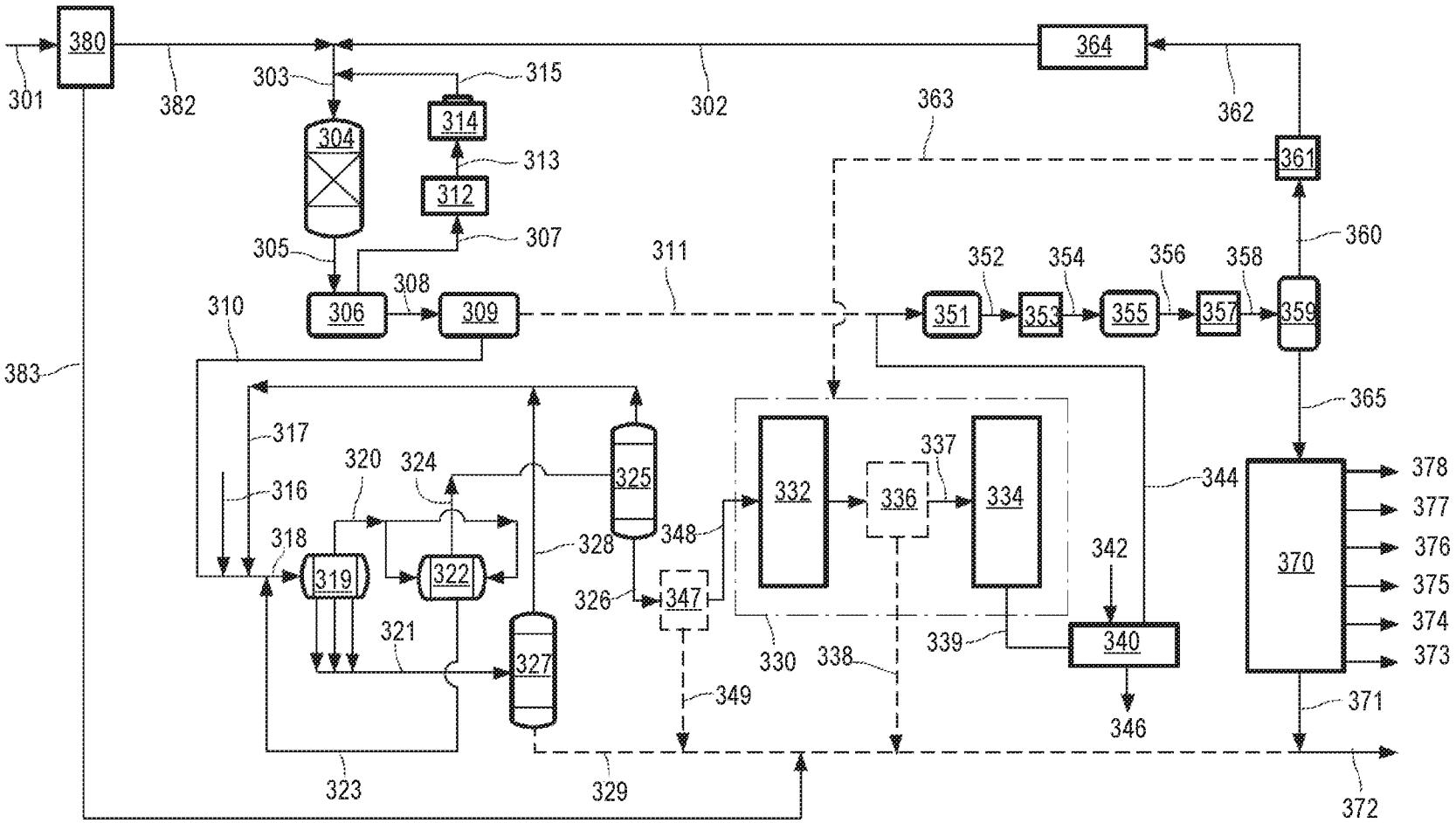
FIG. 4 is a process flow diagram of an embodiment of an integrated process according to the invention.

In an embodiment of a process employing the arrangement shown in FIG. 4, a crude oil feedstock 301 is sent to a separator 380 and separated into a stream 382 and a stream 383, wherein stream 382 is mixed with an effective amount of hydrogen 302 and 315 (and if necessary a source of make-up hydrogen) to form a combined stream 303. The admixture 303 is charged to the hydroprocessing reaction zone 304 at a temperature in the range of from 300° C. to 450° C. In certain embodiments, hydroprocessing reaction zone 304 includes one or more unit operations as described in commonly owned United States Patent Publication Number 2011/0083996 and in PCT Patent Application Publication Numbers WO2010/009077, WO2010/009082, WO2010/009089 and WO2009/073436, all of which are incorporated by reference herein in their entireties. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing zone 304 includes more than two catalyst beds. In further embodiments hydroprocessing reaction zone 304 includes plural reaction vessels each containing one or more catalyst beds, e.g., of different function.

Hydroprocessing zone 304 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity in the range of from 0.1 $h^{-1}$ to 10 $h^{-1}$. Notably, using crude oil as a feedstock in the hydroprocessing zone 304 advantages are demonstrated, for instance, as compared to the same hydroprocessing unit operation employed for atmospheric residue. For instance, at a start or run temperature in the range of 370° C. to 375° C. the deactivation rate is around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 $h^{-1}$ while that for atmospheric residue is typically 0.25 $h^{-1}$. An unexpected finding is that the deactivation rate when processing crude oil is going in the inverse direction from that which is usually observed. Deactivation at low throughput (0.25 $h^{-1}$) is 4.2° C./month and deactivation at higher throughput (0.5 $h^{-1}$) is 2.0° C./month. With every feed which is considered in the industry, the opposite is observed. This can be attributed to the washing effect of the catalyst.

Reactor effluents 305 from the hydroprocessing zone 304 are cooled in an exchanger (not shown) and sent to separators which may comprise a high pressure cold or hot separator 306. Separator tops 307 are cleaned in an amine unit 312 and the resulting hydrogen rich gas stream 313 is passed to a recycling compressor 314 to be used as a recycle gas 315 in the hydroprocessing reaction zone 304. Separator bottoms 308 from the high pressure separator 306, which are in a substantially liquid phase, are cooled and then introduced to a low pressure cold separator 309. Remaining gases, stream 311, including hydrogen, $H_2S$, $NH_3$ and any light hydrocarbons, which can include C1-C4 hydrocarbons, can be conventionally purged from the low pressure cold separator and sent for further processing, such as flare processing or fuel gas processing. In certain embodiments of the present process, hydrogen is recovered by combining stream 311 (as indicated by dashed lines) with the cracking gas, stream 344, from the steam cracker products.

Hydroprocessed effluent 310 contains a reduced content of contaminants (i.e., metals, sulfur and nitrogen), an increased paraffinicity, reduced BMCI, and an increased American Petroleum Institute (API) gravity.

The hydrotreated effluent 310 is admixed with solvent from one or more sources 316, 317 and 328. The resulting mixture 318 is then transferred to the primary settler 319. By mixing and settling, two phases are formed in the primary settler 319: a primary DA/DMO phase 320 and a primary asphalt phase 321. The temperature of the primary settler 319 is sufficiently low to recover all DA/DMO from the feedstock. For instance, for a system using n-butane a suitable temperature range is about 60° C. to 150° C. and a suitable pressure range is such that it is higher than the vapor pressure of n-butane at the operating temperature e.g. about 15 to 25 bars to maintain the solvent in liquid phase. In a system using n-pentane a suitable temperature range is about 60° C. to about 180° C. and again a suitable pressure range is such that it is higher than the vapor pressure of n-pentane at the operating temperature e.g. about 10 to 25 bars to maintain the solvent in liquid phase. The temperature in the second settler is usually higher than the one in the first settler.

The primary DA/DMO phase 320 including a majority of solvent and DA/DMO with a minor amount of asphalt is discharged via the outlet located at the top of the primary settler 319 and collector pipes (not shown). The primary asphalt phase 321, which contains 20-50% by volume of solvent, is discharged via several pipe outlets located at the bottom of the primary settler 319.

The primary DA/DMO phase 320 enters into the two tee-type distributors at both ends of the secondary settler 322 which serves as the final stage for the extraction. A secondary asphalt phase 323 containing a small amount of solvent and DA/DMO is discharged from the secondary settler 322 and recycled back to the primary settler 19 to recover DA/DMO. A secondary DA/DMO phase 324 is obtained and passed to the DA/DMO separation zone 325 to obtain a solvent stream 317 and a solvent-free DA/DMO stream 326. Greater than 90 wt. % of the solvent charged to the settlers enters the DA/DMO separation zone 325, which is dimensioned to permit a rapid and efficient flash separation of solvent from the DA/DMO. The primary asphalt phase 321 is conveyed to the separator vessel 327 for flash separation of a solvent stream 328 and a bottom asphalt phase 329. Solvent streams 317 and 328 can be used as solvent for the primary settler 319, therefore minimizing the fresh solvent 316 requirement.

The solvents used in solvent deasphalting zone include pure liquid hydrocarbons such as propane, butanes and pentanes, as well as their mixtures. The selection of solvents depends on the requirement of DAO, as well as the quality and quantity of the final products. The operating conditions for the solvent deasphalting zone include a temperature at or below critical point of the solvent; a solvent-to-oil ratio in the range of from 2:1 to 50:1 (vol.:vol.); and a pressure in a range effective to maintain the solvent/feed mixture in the settlers is in the liquid state.

The essentially solvent-free DA/DMO stream 326 is optionally steam stripped (not shown) to remove solvent. In certain embodiments the deasphalted and demetallized oil stream 326 is the feed 348 to the steam pyrolysis zone 330. In further embodiments, deasphalted and demetallized oil stream 326 is sent to separation zone 347 wherein the discharged vapor portion is the feed 348 to the steam pyrolysis zone 330. The vapor portion can have, for instance, an initial boiling point corresponding to that of the deasphalted and demetallized oil stream 326 and a final boiling point in the range of about 370° C. to about 600° C. Separation zone 347 an include a suitable vapor-liquid separation unit operation such as a flash vessel, a separation device based on physical or mechanical separation of vapors and liquids or a combination including at least one of these types of devices.

The feed 348 is conveyed to the convection section 332 and a predetermined amount of steam is introduced, e.g., admitted via a steam inlet (not shown). In the convection section 332 the mixture is heated to a predetermined temperature, e.g., using one or more waste heat streams or other suitable heating arrangement. The heated mixture of the pyrolysis feedstream and additional steam is passed to the pyrolysis section 334 to produce a mixed product stream 339. In certain embodiments the heated mixture of from section 332 is passed through a vapor-liquid separation section 336 in which a portion 338 is rejected as a low sulfur fuel oil component suitable for blending with pyrolysis fuel oil 371.

The steam pyrolysis zone 330 operates under parameters effective to crack the DA/DMO stream into desired products including ethylene, propylene, butadiene, mixed butenes and pyrolysis gasoline. In certain embodiments, steam cracking is carried out using the following conditions: a temperature in the range of from 400° C. to 900° C. in the convection section and in the pyrolysis section; a steam-to-hydrocarbon ratio in the convection zone in the range of from 0.3:1 to 2:1 (wt.:wt.); and a residence time in the pyrolysis section in the range of from 0.05 seconds to 2 seconds.

Mixed product stream 339 is passed to the inlet of quenching zone 340 with a quenching solution 342 (e.g., water and/or pyrolysis fuel oil) introduced via a separate inlet to produce a quenched mixed product stream 344 having a reduced temperature, e.g., of about 300° C., and spent quenching solution 346 is recycled and/or purged.

The gas mixture effluent 339 from the cracker is typically a mixture of hydrogen, methane, hydrocarbons, carbon dioxide and hydrogen sulfide. After cooling with water or oil quench, mixture 344 is subjected to compression and separation. In one non-limiting example, stream 344 is compressed in a multi-stage compressor which typically comprises 4-6 stages, wherein said multi-stage compressor may comprise compressor zone 351 to produce a compressed gas mixture 352. The compressed gas mixture 352 may be treated in a caustic treatment unit 353 to produce a gas mixture 354 depleted of hydrogen sulfide and carbon dioxide. The gas mixture 354 may be further compressed in a compressor zone 355. The resulting cracked gas 356 may undergo a cryogenic treatment in unit 357 to be dehydrated, and may be further dried by use of molecular sieves.

The cold cracked gas stream 358 from unit 357 may be passed to a de-methanizer tower 359, from which an overhead stream 360 is produced containing hydrogen and methane from the cracked gas stream. The bottoms stream 365 from de-methanizer tower 359 is then sent for further processing in product separation zone 370, comprising fractionation towers including de-ethanizer, de-propanizer and de-butanizer towers. Process configurations with a different sequence of de-methanizer, de-ethanizer, de-propanizer and de-butanizer can also be employed.

According to the processes herein, after separation from methane at the de-methanizer tower 359 and hydrogen recovery in unit 361, hydrogen 362 having a purity of typically 80-95 vol % is obtained. Recovery methods in unit 361 include cryogenic recovery (e.g., at a temperature of about −157° C.). Hydrogen stream 362 is then passed to a hydrogen purification unit 364, such as a pressure swing adsorption (PSA) unit to obtain a hydrogen stream 302 having a purity of 99.9%+, or a membrane separation units to obtain a hydrogen stream 302 with a purity of about 95%. The purified hydrogen stream 302 is then recycled back to serve as a major portion of the requisite hydrogen for the hydroprocessing zone. In addition, a minor proportion can be utilized for the hydrogenation reactions of acetylene, methylacetylene and propadienes (not shown). In addition, according to the processes herein, methane stream 363 can optionally be recycled to the steam cracker to be used as fuel for burners and/or heaters.

The bottoms stream 365 from de-methanizer tower 359 is conveyed to the inlet of product separation zone 370 to be separated into methane, ethylene, propylene, butadiene, mixed butylenes and pyrolysis gasoline via outlets 378, 377, 376, 375, 374 and 373, respectively. Pyrolysis gasoline generally includes C5-C9 hydrocarbons, and benzene, toluene and xylenes can be separated from this cut. Optionally, one or both of the bottom asphalt phase 329 and the unvaporized heavy liquid fraction 338 from the vapor-liquid separation section 336 are combined with pyrolysis fuel oil 371 (e.g., materials boiling at a temperature higher than the boiling point of the lowest boiling C10 compound, known as a "C10+" stream) from separation zone 370, and the mixed stream is withdrawn as a pyrolysis fuel oil blend 372, e.g., to be further processed in an off-site refinery (not shown). In certain embodiments, the bottom asphalt phase 329 can be sent to an asphalt stripper (not shown) where any remaining solvent is stripped-off, e.g. by steam.

Solvent deasphalting is a unique separation process in which residue is separated by molecular weight (density), instead of by boiling point, as in the vacuum distillation process. The solvent deasphalting process thus produces a low-contaminant deasphalted oil (DAO) rich in paraffinic type molecules, consequently decreases the BMCI as compared to the initial feedstock or the hydroprocessed feedstock.

Solvent deasphalting is usually carried out with paraffin streams having carbon number ranging from 3-7, in certain embodiments ranging from 4-5, and below the critical conditions of the solvent.

The feed is mixed with a light paraffinic solvent with carbon numbers ranging 3-7, where the deasphalted oil is solubilized in the solvent. The insoluble pitch will precipitate out of the mixed solution and is separated from the DAO phase (solvent-DAO mixture) in the extractor.

Solvent deasphalting is carried-out in liquid phase and therefore the temperature and pressure are set accordingly. There are two stages for phase separation in solvent deasphalting. In the first separation stage, the temperature is maintained lower than that of the second stage to separate the bulk of the asphaltenes. The second stage temperature is maintained to control the deasphalted/demetallized oil (DA/DMO) quality and quantity. The temperature has big impact on the quality and quantity of DA/DMO. An extraction temperature increase will result in a decrease in deasphalted/demetallized oil yield, which means that the DA/DMO will be lighter, less viscous, and contain less metals, asphaltenes, sulfur, and nitrogen. A temperature decrease will have the opposite effects. In general, the DA/DMO yield decreases having higher quality by raising extraction system temperature and increases having lower quality by lowering extraction system temperature.

The composition of the solvent is an important process variable. The solubility of the solvent increases with increasing critical temperature, generally according to C3<iC4<nC4<iC5. An increase in critical temperature of the solvent increases the DA/DMO yield. However, it should be noted that the solvent having the lower critical temperature has less selectivity resulting in lower DA/DMO quality.

The volumetric ratio of the solvent to the solvent deasphalting unit charge impacts selectivity and to a lesser degree on the DA/DMO yield. Higher solvent-to-oil ratios result in a higher quality of the DA/DMO for a fixed DA/DMO yield. Higher solvent-to-oil ratio is desirable due to better selectivity, but can result in increased operating costs thereby the solvent-to-oil ratio is often limited to a narrow range. The composition of the solvent will also help to establish the required solvent to oil ratios. The required solvent to oil ratio decreases as the critical solvent temperature increases. The solvent to oil ratio is, therefore, a function of desired selectivity, operation costs and solvent composition.

In certain embodiments, selective hydroprocessing or hydrotreating processes can increase the paraffin content (or decrease the BMCI) of a feedstock by saturation followed by mild hydrocracking of aromatics, especially polyaromatics. When hydrotreating a crude oil, contaminants such as metals, sulfur and nitrogen can be removed by passing the feedstock through a series of layered catalysts that perform the catalytic functions of demetallization, desulfurization and/or denitrogenation.

In one embodiment, the sequence of catalysts to perform hydrodemetallization (HDM) and hydrodesulfurization (HDS) is as follows:

a. A hydrodemetallization catalyst. The catalyst in the HDM section are generally based on a gamma alumina support, with a surface area of about 140-240 $m^2/g$. This catalyst is best described as having a very high pore volume, e.g., in excess of 1 $cm^3/g$. The pore size itself is typically predominantly macroporous. This is required to provide a large capacity for the uptake of metals on the catalysts surface and optionally dopants. Typically the active metals on the catalyst surface are sulfides of Nickel and Molybdenum in the ratio Ni/Ni+Mo<0.15. The concentration of Nickel is lower on the HDM catalyst than other catalysts as some Nickel and Vanadium is anticipated to be deposited from the feedstock itself during the removal, acting as catalyst. The dopant used can be one or more of phosphorus (United States Patent Publication Number US 2005/0211603), boron, silicon and halogens. The catalyst can be in the form of alumina extrudates or alumina beads. In certain embodiments alumina beads are used to facilitate un-loading of the catalyst HDM beds in the reactor as the metals uptake will range between from 30 to 100% at the top of the bed.

b. An intermediate catalyst can also be used to perform a transition between the HDM and HDS function. It has intermediate metals loadings and pore size distribution. The catalyst in the HDM/HDS reactor is essentially alumina based support in the form of extrudates, optionally at least one catalytic metal from group VI (e.g., molybdenum and/or tungsten), and/or at least one catalytic metals from group VIII (e.g., nickel and/or cobalt). The catalyst also contains optionally at least one dopant selected from boron, phosphorous, halogens and silicon. Physical properties include a surface area of about 140-200 $m^2/g$, a pore volume of at least 0.6 $cm^3/g$ and pores which are mesoporous and in the range of 12 to 50 nm.

c. The catalyst in the HDS section can include those having gamma alumina based support materials, with typical surface area towards the higher end of the HDM range, e.g. about ranging from 180-240 $m^2/g$. This required higher surface for HDS results in relatively smaller pore volume, e.g., lower than 1 cm/g. The catalyst contains at least one element from group VI, such as molybdenum and at least one element from group VIII, such as nickel. The catalyst also comprises at least one dopant selected from boron, phosphorous, silicon and halogens. In certain embodiments cobalt is used to provide relatively higher levels of desulfurization. The metals loading for the active phase is higher as the required activity is higher, such that the molar ratio of Ni/Ni+Mo is in the range of from 0.1 to 0.3 and the (Co+Ni)/Mo molar ratio is in the range of from 0.25 to 0.85.

d. A final catalyst (which could optionally replace the second and third catalyst) is designed to perform hydrogenation of the feedstock (rather than a primary function of hydrodesulfurization), for instance as described in Appl. Catal. A General, 204 (2000) 251. The catalyst will be also promoted by Ni and the support will be wide pore gamma alumina. Physical properties include a surface area towards the higher end of the HDM range, e.g., 180-240 $m^2/g$. This required higher surface for HDS results in relatively smaller pore volume, e.g., lower than 1 $cm^3/g$.

The methods and systems herein provide improvements over known steam pyrolysis cracking processes: use of crude oil as a feedstock to produce petrochemicals such as olefins and aromatics; the hydrogen content of the feed to the steam pyrolysis zone is enriched for high yield of olefins; coke precursors are significantly removed from the initial whole crude oil which allows a decreased coke formation in the radiant coil; and additional impurities such as metals, sulfur and nitrogen compounds are also significantly removed from the starting feed which avoids post treatments of the final products.

In addition, hydrogen produced from the steam cracking zone is preferably recycled to the hydroprocessing zone to minimize the demand for fresh hydrogen. In certain embodiments the integrated systems described herein only require fresh hydrogen to initiate the operation. Once the reaction reaches the equilibrium, the hydrogen purification system can provide enough high purity hydrogen to maintain the operation of the entire system.

The invention claimed is:

1. An integrated hydrotreating and steam pyrolysis process for the direct processing of crude oil to produce olefinic and aromatic petrochemicals, the process comprising:

(a1) separating the crude oil into a first hydrocarbon stream and a second hydrocarbon stream comprising asphaltenes;

(b1) charging the second hydrocarbon stream to a solvent deasphalting zone with an effective amount of solvent for producing a deasphalted and demetallized oil stream and an asphalt phase, wherein the solvent comprises a pure liquid hydrocarbon selected from the group consisting of propane, butanes and pentanes, and mixtures thereof, wherein deasphalting is conducted at a temperature at or below critical point of the solvent, a solvent-to-oil ratio is in the range of from 2:1 to 50:1, and a pressure is in a range effective to maintain the solvent/feed mixture, which is in a settler, in a liquid state;

(c1) charging the deasphalted and demetallized oil stream, the first hydrocarbon stream and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity, wherein the hydroprocessing zone is operated at a temperature in the range of from 300° C. to 450° C., a pressure in the range of from 30 bar to 180 bar, and a liquid hourly space velocity in the range of from 0.1 $h^{-1}$ to 10 $h^{-1}$;

(d1) thermally cracking at least a portion of the hydroprocessed effluent in the presence of steam in a steam pyrolysis zone to produce a mixed product stream;

(e1) separating hydrogen from the thermally cracked mixed product stream;

(f1) purifying hydrogen recovered in step (e1) and recycling it to step (c1);

(g1) recovering olefins and aromatics from the separated mixed product stream; and (h1) recovering a combined stream of pyrolysis fuel oil from the separated mixed product stream and the asphalt phase from step (b1) as a fuel oil blend.

2. The integrated process of claim 1, further comprising:

separating the hydroprocessed effluent in a high pressure separator to recover a gas portion that is cleaned and recycled to the hydroprocessing zone as an additional source of hydrogen, and a liquid portion, and separating the liquid portion from the high pressure separator in a low pressure separator into a second gas portion and a second liquid portion, wherein the second liquid portion from the low pressure separator is the at least a portion of the hydroprocessed effluent subjected to thermal cracking and the second gas portion from the low pressure separator is combined with the mixed product stream after the steam pyrolysis zone and before the separation in step (e1).

3. The integrated process of claim 1, wherein the hydroprocessing zone includes more than two catalyst beds.

4. The integrated process of claim 1, wherein the hydroprocessing zone includes one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions.

5. The integrated process of claim 1, wherein the hydroprocessing zone includes a plurality of reaction vessels each containing one or more catalyst beds of different function.

6. The integrated process of claim 1, wherein the hydroprocessing zone is operated at a temperature of 300° C., a pressure of 30 bar, and a liquid hourly space velocity of 0.1 $h^{-1}$.

7. The integrated process of claim 1, wherein the hydroprocessing zone is operated at a temperature of 450° C., a pressure of 180 bar, and a liquid hourly space velocity of 0.1 $h^{-1}$.

8. The integrated process of claim 2, wherein the hydroprocessing zone is operated at a temperature of 450° C., a pressure of 180 bar, and a liquid hourly space velocity of 0.1 $h^{-1}$.

9. The integrated process of claim 3, wherein the hydroprocessing zone is operated at a temperature of 450° C., a pressure of 180 bar, and a liquid hourly space velocity of 0.1 $h^{-1}$.

10. The integrated process of claim 2, wherein the hydroprocessing zone is operated at a temperature of 300° C., a pressure of 30 bar, and a liquid hourly space velocity of 0.1 $h^{-1}$.

11. The integrated process of claim 3, wherein the hydroprocessing zone is operated at a temperature of 300° C., a pressure of 30 bar, and a liquid hourly space velocity of 0.1 $h^{-1}$.

12. The integrated process of claim 1, wherein the hydroprocessing zone is operated at a temperature of 450° C., a pressure of 180 bar, and a liquid hourly space velocity of 10 $h^{-1}$.

13. The integrated process of claim 2, wherein the hydroprocessing zone is operated at a temperature of 300° C., a pressure of 30 bar, and a liquid hourly space velocity of 10 $h^{-1}$.

14. The integrated process of claim 3, wherein the hydroprocessing zone is operated at a temperature of 300° C., a pressure of 30 bar, and a liquid hourly space velocity of 10 $h^{-1}$.

15. The integrated process of claim 1, further comprising:

separating the hydroprocessed effluent in a high pressure separator to recover a gas portion that is cleaned and recycled to the hydroprocessing zone as an additional source of hydrogen, and a liquid portion, and separating the liquid portion from the high pressure separator in a low pressure separator into a second gas portion and a second liquid portion, wherein the second liquid portion from the low pressure separator is the at least a portion of the hydroprocessed effluent subjected to thermal cracking and the second gas portion from the low pressure separator is combined with the mixed product stream after the steam pyrolysis zone and before the separation in step (e1);

wherein make-up hydrogen is also provided in step (c1);

wherein the thermal cracking step includes the steps of heating the at least a portion of the hydroprocessed effluent in a convection section of the steam pyrolysis zone, separating the heated hydroprocessed effluent into a vapor fraction and a liquid fraction, passing the vapor fraction to a pyrolysis section of the steam pyrolysis zone, and discharging a liquid fraction;

wherein separating the heated hydroprocessed effluent into a vapor fraction and a liquid fraction is with a vapor-liquid separation device based on physical and mechanical separation;

wherein the vapor-liquid separation device includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes;

wherein step (e1) includes the steps of compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide;

dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (g1) and pyrolysis fuel oil as in step (h1) from the remainder of the dehydrated compressed thermally cracked mixed product stream with a reduced content of hydrogen sulfide and carbon dioxide;

wherein step (f1) comprises purifying recovered hydrogen from the dehydrated compressed thermally cracked mixed product stream with a reduced content of hydrogen sulfide and carbon dioxide for recycle to the hydroprocessing zone; and wherein recovering hydrogen from the dehydrated compressed thermally cracked mixed product stream with a reduced content of hydrogen sulfide and carbon dioxide further includes the step of separately recovering methane for use as fuel for burners and/or heaters in the thermal cracking step.

16. The integrated process of claim 15, wherein the hydroprocessing zone is operated at a temperature of 300° C., a pressure of 30 bar, and a liquid hourly space velocity of 0.1 $h^{-1}$.

17. The integrated process of claim 15, wherein the hydroprocessing zone is operated at a temperature of 450° C., a pressure of 180 bar, and a liquid hourly space velocity of 0.1 $h^{-1}$.

18. An integrated hydrotreating and steam pyrolysis process for the direct processing of crude oil to produce olefinic and aromatic petrochemicals, the process comprising:

(a1) separating the crude oil into a first hydrocarbon stream and a second hydrocarbon stream comprising asphaltenes;

(b1) charging the second hydrocarbon stream to a solvent deasphalting zone with an effective amount of solvent for producing a deasphalted and demetallized oil stream and an asphalt phase, wherein the solvent comprises a pure liquid hydrocarbon selected from the group consisting of propane, butanes and pentanes, and mixtures thereof, wherein deasphalting is conducted at a temperature at or below critical point of the solvent, a solvent-to-oil ratio is in the range of from 2:1 to 50:1, and a pressure is in a range effective to maintain the solvent/feed mixture, which is in a settler, in a liquid state;

(c1) charging the deasphalted and demetallized oil stream, the first hydrocarbon stream and hydrogen to a hydroprocessing zone operating under conditions effective to produce a hydroprocessed effluent having a reduced content of contaminants, an increased paraffinicity, reduced Bureau of Mines Correlation Index, and an increased American Petroleum Institute gravity, wherein the hydroprocessing zone is operated at a temperature in the range of from 300° C. to 450° C., a pressure in the range of from 30 bar to 180 bar, and a liquid hourly space velocity in the range of from 0.1 $h^{-1}$ to 10 $h^{-1}$;

(d1) thermally cracking at least a portion of the hydroprocessed effluent in the presence of steam in a steam pyrolysis zone to produce a mixed product stream;

(e1) separating hydrogen from the thermally cracked mixed product stream;

(f1) purifying hydrogen recovered in step (e1) and recycling it to step (c1);

(g1) recovering olefins and aromatics from the separated mixed product stream; and (h1) recovering a combined stream of pyrolysis fuel oil from the separated mixed product stream and the asphalt phase from step (b1) as a fuel oil blend;

further comprising separating the hydroprocessed effluent in a high pressure separator to recover a gas portion that is cleaned and recycled to the hydroprocessing zone as an additional source of hydrogen, and a liquid portion, and separating the liquid portion from the high pressure separator in a low pressure separator into a second gas portion and a second liquid portion, wherein the second liquid portion from the low pressure separator is the at least a portion of the hydroprocessed effluent subjected to thermal cracking and the second gas portion from the low pressure separator is combined with the mixed product stream after the steam pyrolysis zone and before the separation in step (e1);

wherein make-up hydrogen is also provided in step (c1);

wherein the thermal cracking step includes the steps of heating the at least a portion of the hydroprocessed effluent in a convection section of the steam pyrolysis zone, separating the heated hydroprocessed effluent into a vapor fraction and a liquid fraction, passing the vapor fraction to a pyrolysis section of the steam pyrolysis zone, and discharging a liquid fraction;

wherein separating the heated hydroprocessed effluent into a vapor fraction and a liquid fraction is with a vapor-liquid separation device based on physical and mechanical separation;

wherein the vapor-liquid separation device includes a pre-rotational element having an entry portion and a transition portion, the entry portion having an inlet for receiving the flowing fluid mixture and a curvilinear conduit, a controlled cyclonic section having an inlet adjoined to the pre-rotational element through convergence of the curvilinear conduit and the cyclonic section, a riser section at an upper end of the cyclonic member through which vapors pass; and a liquid collector/settling section through which liquid passes;

wherein step (e1) includes the steps of compressing the thermally cracked mixed product stream with plural compression stages; subjecting the compressed thermally cracked mixed product stream to caustic treatment to produce a thermally cracked mixed product stream with a reduced content of hydrogen sulfide and carbon dioxide; compressing the thermally cracked mixed product stream with a reduced content of hydrogen sulfide and carbon dioxide; dehydrating the compressed thermally cracked mixed product stream with a reduced content of hydrogen sulfide and carbon dioxide; recovering hydrogen from the dehydrated compressed thermally cracked mixed product stream with a reduced content of hydrogen sulfide and carbon dioxide; and obtaining olefins and aromatics as in step (g1) and pyrolysis fuel oil as in step (h1) from the remainder of the dehydrated compressed thermally cracked mixed product stream with a reduced content of hydrogen sulfide and carbon dioxide;

wherein step (f1) comprises purifying recovered hydrogen from the dehydrated compressed thermally cracked mixed product stream with a reduced content of hydrogen sulfide and carbon dioxide for recycle to the hydroprocessing zone; and wherein recovering hydrogen from the dehydrated compressed thermally cracked mixed product stream with a reduced content of hydrogen sulfide and carbon dioxide further includes the step of separately recovering methane for use as fuel for burners and/or heaters in the thermal cracking step.

* * * * *